US009070544B1

(12) United States Patent
Shaps et al.

(10) Patent No.: US 9,070,544 B1
(45) Date of Patent: Jun. 30, 2015

(54) LIGHT BULB INSTALLATION AND REMOVAL TOOL

(71) Applicant: Snatcher, LLC, Scottsdale, AZ (US)

(72) Inventors: Robert Shaps, Paradise Valley, AZ (US); Murray Neal, Scottsdale, AZ (US)

( * ) Notice: Subject to any disclaimer, the term of this patent is extended or adjusted under 35 U.S.C. 154(b) by 0 days.

(21) Appl. No.: 14/507,029

(22) Filed: Oct. 6, 2014

Related U.S. Application Data

(60) Provisional application No. 62/007,691, filed on Jun. 4, 2014.

(51) Int. Cl.
*H01K 3/32* (2006.01)
*H01J 9/00* (2006.01)
*B25B 23/00* (2006.01)

(52) U.S. Cl.
CPC . *H01K 3/32* (2013.01); *H01J 9/003* (2013.01); *B25B 23/0028* (2013.01)

(58) Field of Classification Search
CPC ..... H01K 3/00; H01K 3/32; H01J 9/00; H01J 9/003; H01J 9/006; B25B 23/0028
USPC ..... 81/53.1, 53.11, 53.12
See application file for complete search history.

(56) References Cited

U.S. PATENT DOCUMENTS

| | | | | |
|---|---|---|---|---|
| 558,573 | A | 4/1896 | Smith | |
| 609,421 | A | 8/1898 | Edwards | |
| 623,180 | A | 4/1899 | Rhine | |
| 634,419 | A | 10/1899 | Weldon | |
| 636,229 | A | 10/1899 | Sims | |
| 659,631 | A | 10/1900 | Croteau et al. | |
| 673,191 | A | 4/1901 | Arthur | |
| 675,640 | A | 6/1901 | Renard | |
| 697,961 | A * | 4/1902 | Ainsworth | 81/53.11 |
| 750,408 | A | 1/1904 | Speelman | |
| 801,902 | A | 10/1905 | Olafson | |
| 809,985 | A * | 1/1906 | Roundberg | 81/53.11 |
| 869,836 | A | 10/1907 | Gaynor | |
| 895,625 | A | 8/1908 | Gaynor | |
| 898,696 | A | 9/1908 | Southworth | |
| 925,084 | A | 6/1909 | Edgerton | |
| 927,908 | A | 7/1909 | Webb | |
| 977,158 | A | 11/1910 | Berkstresser | |
| 987,562 | A | 3/1911 | Ferguson | |
| 1,056,084 | A | 3/1913 | Bates | |
| 1,133,613 | A | 3/1915 | Buss et al. | |
| 1,193,685 | A | 8/1916 | Harvey | |

(Continued)

*Primary Examiner* — Hadi Shakeri
(74) *Attorney, Agent, or Firm* — Whitley Legal Group, PC; AnnMarie W. Whitley

(57) ABSTRACT

An installation and removal tool for light bulbs and similar items comprising modular and interchangeable attachment heads, a pole, an articulating joint, and an extraction head. Attachment heads comprise a gripping unit and a handle and are each configured to cooperate with one or more light bulb shapes and/or sizes and further comprises an adhesive system. Several embodiments of the gripping unit comprise a bulb cavity with an engagement surface and a release lip and an adhesive system mounted on the engagement surface such that an air channel is created surrounding the adhesive system. The adhesive system comprises pressure sensitive adhesive and preferably defines an opening in fluid communication with a bore defined by the handle to accommodate extended and oddly shaped bulbs. A protective liner that cooperates with the adhesive component to preserve the functionality of the adhesive when it is not in use.

14 Claims, 22 Drawing Sheets

(56) References Cited

U.S. PATENT DOCUMENTS

| | | | | | |
|---|---|---|---|---|---|
| 1,201,506 | A | | 10/1916 | Rozelle et al. | |
| 1,202,432 | A | | 10/1916 | Rozelle et al. | |
| 1,210,835 | A | | 1/1917 | Price | |
| 1,223,791 | A | | 4/1917 | Jackson | |
| 1,258,430 | A | | 3/1918 | Morris | |
| 1,311,776 | A | | 7/1919 | Rodriguez | |
| 1,449,358 | A | | 3/1923 | Weber | |
| 1,514,814 | A | | 11/1924 | Allen | |
| 1,540,143 | A | | 6/1925 | Pierpoint | |
| 1,541,839 | A | | 6/1925 | Metzler et al. | |
| 1,655,979 | A | | 1/1928 | Watkins | |
| 1,787,670 | A | | 1/1931 | Clarkson | |
| 1,823,170 | A | | 9/1931 | Schulz | |
| 1,847,953 | A | | 3/1932 | Finesey | |
| 2,117,017 | A | | 5/1938 | Chadsey | |
| 2,157,563 | A | | 5/1939 | Pethick | |
| 2,191,593 | A | | 2/1940 | Griffen et al. | |
| 2,357,104 | A | | 8/1944 | Grinnell | |
| 2,357,105 | A | | 8/1944 | Grinnell | |
| 2,385,820 | A | * | 10/1945 | Leibow | 81/53.11 |
| 2,387,846 | A | | 10/1945 | Hays | |
| 2,473,008 | A | | 6/1949 | Chadsey | |
| 2,526,084 | A | * | 10/1950 | Penn | 81/53.11 |
| 2,545,043 | A | | 3/1951 | Odenthal | |
| 2,556,701 | A | | 6/1951 | Mendoza | |
| 2,573,002 | A | | 10/1951 | Foster | |
| 2,607,620 | A | | 8/1952 | Oliveri | |
| 2,616,743 | A | | 11/1952 | Negley | |
| 2,634,998 | A | | 4/1953 | Flower | |
| 2,637,587 | A | | 5/1953 | Robinson | |
| 2,669,478 | A | | 2/1954 | Bowie | |
| 2,722,448 | A | | 11/1955 | Popp et al. | |
| 2,946,615 | A | | 7/1960 | Yawman, Jr. et al. | |
| 2,983,541 | A | | 5/1961 | Maki | |
| 3,101,966 | A | | 8/1963 | Thomas et al. | |
| 3,192,589 | A | | 7/1965 | Pearson | |
| 3,342,519 | A | | 9/1967 | Hunt et al. | |
| 3,549,188 | A | | 12/1970 | Cerasoli | |
| 3,666,311 | A | | 5/1972 | McMullin | |
| 3,696,694 | A | | 10/1972 | Boro | |
| 3,708,382 | A | | 1/1973 | Erb | |
| 3,731,966 | A | | 5/1973 | Nagy | |
| 3,776,584 | A | | 12/1973 | Van Gerven | |
| 3,788,691 | A | | 1/1974 | McMullin | |
| 3,799,599 | A | | 3/1974 | Jordan | |
| 4,609,581 | A | | 9/1986 | Tochacek et al. | |
| 4,611,512 | A | | 9/1986 | Honda | |
| 4,663,996 | A | | 5/1987 | Grudgfield et al. | |
| 4,719,826 | A | | 1/1988 | DuBois | |
| 4,730,960 | A | | 3/1988 | Lewis et al. | |
| 4,761,318 | A | | 8/1988 | Ott et al. | |
| D297,499 | S | | 9/1988 | Whitney | |
| 4,770,917 | A | | 9/1988 | Tochacek et al. | |
| 4,791,835 | A | | 12/1988 | Unger et al. | |
| 4,844,171 | A | | 7/1989 | Russell et al. | |
| 4,852,925 | A | | 8/1989 | Lodin | |
| 4,864,899 | A | | 9/1989 | Morse | |
| 4,876,929 | A | | 10/1989 | Kozak | |
| 4,901,606 | A | | 2/1990 | Christensen | |
| 4,910,062 | A | | 3/1990 | Zinke et al. | |
| 5,103,695 | A | | 4/1992 | Dolle et al. | |
| 5,123,311 | A | | 6/1992 | Dymek | |
| 5,148,723 | A | * | 9/1992 | Newman et al. | 81/53.11 |
| 5,218,889 | A | | 6/1993 | Brockberg | |
| 5,317,939 | A | | 6/1994 | Marinescu | |
| 5,330,243 | A | | 7/1994 | Held | |
| 5,379,666 | A | | 1/1995 | Held | |
| 5,385,420 | A | | 1/1995 | Newman, Sr. et al. | |
| 5,386,744 | A | | 2/1995 | Garcia | |
| 5,436,051 | A | | 7/1995 | Donaruma et al. | |
| 5,436,526 | A | | 7/1995 | Hohaus et al. | |
| 5,458,026 | A | | 10/1995 | Southard et al. | |
| 5,490,438 | A | | 2/1996 | Zupo et al. | |
| 5,564,852 | A | | 10/1996 | Maxwell et al. | |
| 5,572,913 | A | | 11/1996 | Naisell | |
| 5,593,196 | A | | 1/1997 | Baum et al. | |
| 5,647,622 | A | | 7/1997 | Schectman | |
| 5,679,302 | A | | 10/1997 | Miller et al. | |
| 5,692,417 | A | | 12/1997 | Irpino | |
| 5,697,269 | A | | 12/1997 | Tseng | |
| 5,730,033 | A | | 3/1998 | Mitrowski | |
| 5,809,850 | A | * | 9/1998 | Tickner | 81/53.11 |
| 5,823,073 | A | | 10/1998 | Tickner | |
| 5,941,139 | A | | 8/1999 | Vodehnal | |
| 5,953,797 | A | | 9/1999 | Provost et al. | |
| 6,223,628 | B1 | | 5/2001 | Barron | |
| 6,254,303 | B1 | | 7/2001 | Falat et al. | |
| 6,257,095 | B1 | | 7/2001 | Yukness | |
| 6,260,442 | B1 | | 7/2001 | Bayat | |
| 6,453,777 | B1 | | 9/2002 | Newman et al. | |
| 6,553,872 | B1 | | 4/2003 | Tse et al. | |
| 6,739,220 | B1 | | 5/2004 | Johnson et al. | |
| 6,826,983 | B1 | | 12/2004 | Magdi | |
| 6,877,400 | B2 | * | 4/2005 | Weaver et al. | 81/53.1 |
| 6,883,400 | B2 | | 4/2005 | Sugano | |
| 6,941,841 | B2 | | 9/2005 | Johnson et al. | |
| 7,131,352 | B1 | | 11/2006 | Saunders | |
| 7,143,668 | B2 | | 12/2006 | Johnson et al. | |
| 7,255,024 | B2 | | 8/2007 | Johnson et al. | |
| 7,270,031 | B1 | * | 9/2007 | Huls | 81/53.11 |
| 7,334,503 | B1 | | 2/2008 | Newman | |
| 7,707,912 | B1 | * | 5/2010 | Sparks | 81/3.4 |
| 7,631,907 | B2 | | 12/2010 | Johnson et al. | |
| 7,856,907 | B2 | | 12/2010 | Johnson et al. | |
| 8,104,380 | B2 | | 1/2012 | Johnson et al. | |
| 8,539,863 | B2 | | 9/2013 | Gatski | |
| 8,555,749 | B2 | * | 10/2013 | Gatski | 81/53.11 |
| 2004/0025641 | A1 | | 2/2004 | Sugano | |
| 2005/0178246 | A1 | | 8/2005 | Johnson et al. | |

* cited by examiner

LIGHT BULB INSTALLATION AND REMOVAL TOOL

CROSS-REFERENCE TO RELATED APPLICATIONS

This application claims the benefit of provisional U.S. Application No. 62/007,691 filed Jun. 4, 2014.

FIELD OF INVENTION

This invention relates to light bulbs and tools for installing and removing light bulbs. More particularly, this invention relates to an installation and removal tool for multiple types, shapes, and installations of light bulbs and for removal and installation of light bulbs positioned in remote or inconvenient locations.

BACKGROUND OF THE INVENTION

Each year there are several millions of light bulbs sold around the globe. The typical residence with today's modern architecture utilizes approximately fifty light bulb fixtures, with an additional increased amount for exterior lighting and landscape illumination. These light bulbs are available in an exceptionally wide variety of designs with various shapes, dimensions and coatings. Some light bulb shapes are generally classified as A shape such as standard household light bulbs, C shaped such as candelabra light bulbs, or PAR shaped such as flood lights and parabolic aluminized reflector lamps. Within those classifications and beyond those classifications, light bulbs fall into hundreds of variations of shapes and sizes and include the following bulb shapes: standard household incandescent, bulged, blown tubular, bulged reflector, candle, candle angular, candle twisted, crystalline pear, extended candle, ellipsoidal, ellipsoidal dimple, ellipsoidal reflector, flambeau, globe, decorator, Krypton, pear, hexagonal candle, ogive, pear-straight, sealed beam, blown reflector, double reflector, straight sided, straight tubular, tubular, and tubular angular. Newer non-filament fluorescent and light emitting diode (LED) base bulbs are replacing older filament bulbs which will no longer be produced fulfilling the new energy saving code requirement changes from various countries. Newer fluorescent light bulbs include full-size fluorescent lamps that are available in several shapes, including straight, U-shaped, and circular configurations, and compact fluorescent lamps (CFLs) that come in a variety of sizes and shapes including twin-tube integral, triple-tube integral, integral model with casing that reduces glare, modular circline and ballast, and modular quad-tube and ballast. LED lights come in nearly as many shapes and sizes as traditional light bulbs.

Numerous light bulb removal and replacement devices have been developed that are designed to alleviate the difficulties of removing and replacing light bulbs in difficult to reach locations or at elevations above the floor or ground level. Light bulbs can be difficult to remove and replace, for example, where they are located beyond someone's reach, where they are offset from a traditional substantially vertical orientation, or where they are tightly fit in a light fixture due to age or over-tightening. Additionally, light bulbs can be difficult to remove and replace due to their size, shape, or construction and materials.

Current incandescent bulb designs which are especially difficult to remove or replace and for which there are no commercially-available removal tools include the following light bulb shapes: the candle, candle angular, candle twisted, flambeau, extended candle, hexagonal candle, tubular, tubular angle, and the newer twisted and linear designs. The most difficult styles are those with the protruding flame tip, which is extremely fragile and readily broken. The others are difficult due to their thin lined and semi-pointed designs.

Compact fluorescent bulbs, often referred to as compact fluorescent lamps (CFLs), are also difficult to remove and replace because they are easily broken, especially the linear designed CFLs. Both spiral and linear CFLs are constructed with one or more small U-shaped (biaxial) straight or twisted glass tubes that are more fragile than incandescent bulbs due to manufacturing defects such as deformations in their walls and due to the lack of additional support especially for bulbs with a long length relative to its diameter. Applying centripetal/torsion forces during an installation or removal either with one's hands or with an ordinary light bulb removal tool may cause the ends of the tubes to flex towards each other causing one or more of the tubes to shatter. Shattered CFLs pose a risk of laceration from the glass itself and of exposing one to toxic reactions to phosphor, which is used to coat the inside of the CFL tubes.

Tools for installing and removing light bulbs have been developed to try to alleviate the problems associated with removing and replacing hard to reach light bulbs. For example, tools include designs that incorporate suction cups, fingers, recessed cups, jaws, split compression projections, and adhesives. Each tool or design, however, has drawbacks.

Light bulb installation and removal tools using suction cups are traditionally designed to cooperate with incandescent glass light bulbs having large round globular distal ends with sufficient surface area for receiving a suction cup. When the suction cup is applied to the distal end of the light bulb, it provides a temporarily secure connection to the light bulb such that when the tool is rotated, the bulb can rotate as well. Unfortunately, the suction cup design is limited to a small segment of commercially available light bulb designs. The suction cup design will not work with light bulbs that have insufficient surface shape and area for creating adequate suction, and/or a contaminated surface.

Light bulb installation and removal tools that use a finger gripping design also are designed to cooperate with bulbs having a larger rounded "globular" glass distal end with sufficient surface area and a sufficient radial edge for symmetrically arranged projecting fingers to grasp the radial edge and secure a firm grasp on the light bulb. The projecting fingers are designed to extend around the radial edge of the bulb and to apply pressure or otherwise grip the edge of the bulb such that when the tool is rotated, the bulb also rotates. Unfortunately, the finger gripping designs do not work with all shapes of light bulbs or close fitting decorative fixture surrounds, and generally are difficult to properly orient and use.

Light bulb installation and removal tools that use a recessed cup design also are designed to cooperate with bulbs having a larger rounded "globular" glass distal end with a relative flat surface and with a sufficient radial edge for achieving frictional contact with the tool. The recessed cup is designed to fit around the radial edge of the bulb and apply friction so that when the cup is rotated, the bulb also rotates. Generally the recessed cups comprise resilient materials that are designed with varying surface shapes and dimensions to provide increased circumferential frictional contact to eliminate slippage around the glass bulb. Unfortunately, like the other designs, the recessed cup design does not work with all shapes of light bulbs, exhibits early age deterioration with increased brittleness and stiffness, and are generally is difficult to use.

Light bulb installation and removal tools that use a jaw gripping design are designed to primarily cooperate with CFLs having biaxial glass tubes. The jaw gripping design operates like a pair of pliers to apply oppositional forces around the bulb's extended tubes so that when force is applied, the bulb can be rotated or pulled as the tool is rotated or pulled. Despite efforts to pad the gripping components of the jaw gripping design, it is still possible to break the light bulb when using the tool. Additionally, it does not work with a wide variety of bulb shapes.

Light bulb installation and removal tools that use a split compression design are designed to primarily cooperate with single long linear florescent light bulbs and especially for ones that exceed 12 inches in length. They are designed from tubes which are split into two halves, with or without a padding on the concave sides to minimize glass breakage. The two halves are designed as hinged, spring loaded, clasp fastening, with Velcro® closures, metallic or polymer clasps, etc. Unfortunately, like the other designs, the split compression tool may break the bulb and does not work with a wide variety of bulb shapes.

Known light bulb installation and removal tools that use adhesive generally combine adhesive with a concave shape tool, a flat tool, or a split compression tool. Unfortunately, the known adhesive designs incorporate adhesives that harden after one or two uses rendering the tool a single-use tool such as the tool described in U.S. Pat. No. 558,573 issued to Hunt et al. In order to combat the problems encountered in Hunt, newer designs, such as the tool described in U.S. Pat. Nos. 8,539,863 and 8,555,749 issued to Gatski, use multiple layered disposable adhesive sheets. Unfortunately, layering multiple adhesive sheets introduces a further problem as the sheets will twist and separate when the tool is used to remove a bulb.

For each of the types of installation and removal tools available, none are configured to assist with removing bulbs in light figures that are mounted at odd angles. While devices such as those taught in U.S. Pat. Nos. 558,573, 578,394, 623,180, 634,419, 636,229, 750,408, 801,902, 1,193,685, 1,201,506, 1,202,432, 1,210,835, 1,311,776, 1,449,358, 1,541,839, 1,847,953, 2,473,008, and 6,883,400 provide solutions for bulbs in oddly mounted fixtures, each as functional drawbacks and none are configured to cooperate with a variety of tools configured to cooperate with a large number of light bulb types, shapes, and sizes.

For each of the types of installation and removal tools available, none also provide an extraction component for cooperating with broken bulbs. Occasionally a bulb breaks or becomes separated from its base while it is either being securely installed or removed from the electrical socket within the light fixture. The portions of the light bulb which remain in the electrical socket are the metallic base cap with or without the central light bulb filament glass stem, which may or may not be surrounded by broken glass from the bulb itself. Known extraction tools rely on a process by which the base is either reamed out, is pierced and then twisted out with pressure, or is removed by pressure and friction against the inside wall of the metallic base cap. The following patents teach extraction tools for broken bulbs: U.S. Pat. Nos. 2,117,017, 3,549,188, 5,386,744, 5,458,026, 5,490,438, and 6,260,442. Unfortunately, the known designs tend to deform the shape of the base and make it more difficult to remove from the socket.

Given the limitations of the prior art, it would be desirable to provide a light bulb removal and installation tool that accommodates a wide variety of light bulbs including those with extended tips and unusual shapes. Additionally, it would be desirable to provide a tool that includes modular and interchangeable components to assist with reaching light fixtures in elevated or angled locations. Moreover, it would be desirable to provide a tool that also accommodates the removal of broken light bulbs while minimizing the likelihood of deforming the broken bulb base. Finally, it would be desirable to provide an installation and removal tool for light bulbs that is easy to operate and that maintains its functionality over multiple installation and removal applications.

SUMMARY OF THE INVENTION

An installation and removal tool for light bulbs and similar items is designed to increase accessibility of exposed or recessed light bulbs in elevated locations. The device comprises modular and interchangeable components: one or more attachment heads, a pole, an articulating joint, and an extraction head. Each embodiment of the attachment heads includes a gripping unit and a handle that is configured to cooperate with a telescoping pole and to cooperate with a user's hand when a telescoping pole is not needed. Each gripping unit has a geometry designed to cooperate with one or more light bulb shapes and/or sizes and further comprises an adhesive system. Three embodiments of the gripping unit are specifically designed with a multi-diameter cup and a bulb cavity comprising a release lip and engagement surface for cooperating with various sizes of popular light bulb designs including flame tip designs. Another embodiment of the gripping unit is specifically designed with two extensions for cooperating with linear tube or spiral design bulbs. The adhesive system comprises a mounting component that attaches the adhesive system to the gripping unit, an adhesive component that comprises a pressure sensitive adhesive and attaches to the mounting component with hook and loop fasteners, and a protective liner that cooperates with the adhesive component to preserve the functionality of the adhesive when it is not in use. Optionally, the adhesive system can also include a spacer combined with a second adhesive system. The adhesive components are configured such that an air channel surrounds the adhesive components and is defined by the bulb cavity release lip, bulb cavity engagement surface, and outer edge of the adhesive system. The adhesive components are further configured such that a light bulb with an oddly shaped distal end can protrude through an opening defined by the adhesive components. The articulating joint comprises an articulating flexible knuckle arrangement configured to facilitate angled gripping applications. The extraction head comprises a broken bulb extraction assembly configured to cooperate with a light bulb base cap. The modular and interchangeable components can be used together or individually depending on the location and type of bulb or application. The components are preferably combined in a kit to allow the user to easily interchange components as needed.

DETAILED DESCRIPTION OF THE INVENTION

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one. Also in this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1:
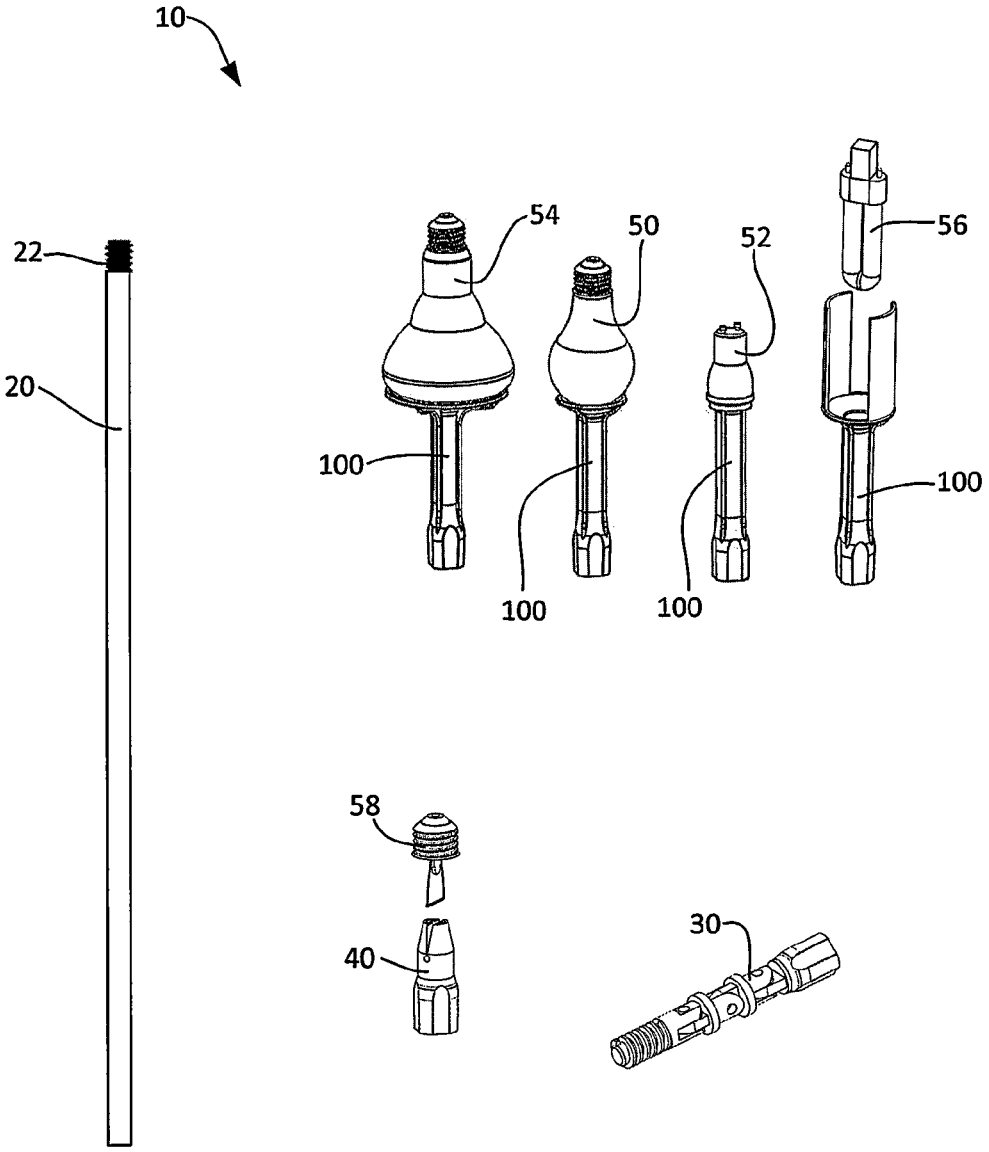
FIG. 1 is an illustration of the modular and interchangeable cooperating components of the present invention.

An installation and removal tool for light bulbs and similar items, as shown in the Figures, is designed to increase accessibility of exposed or recessed light bulbs in elevated locations. The device 10 comprises modular and interchangeable components including one or more attachment heads 100, a pole 20, an articulating joint 30, and an extraction head 40, as shown in FIG. 1. Each embodiment of the attachment heads includes a gripping unit 110 or 150 and a handle 104. Handle 104 is configured to cooperate with the pole 20 and to cooperate with a user's hand when the pole 20 is not needed and defines a channel or bore 106 to facilitate a wider variety of light bulb shapes. Each gripping unit 110 and 150 has a geometry designed to cooperate with one or more light bulb shapes and/or sizes and further comprises an adhesive system 120. Several similar embodiments of the gripping unit 110 are specifically designed with a bulb cavity 112 for cooperating with various sizes of popular light bulb designs including flame tip designs and comprise a release lip 114 and bulb cavity engagement surface 112*a*. Another embodiment of the gripping unit 150 is specifically designed with two extensions 132 for cooperating with linear tube or spiral design bulbs. The adhesive system 120 comprises a mounting component 122 that attaches the adhesive system to the bulb cavity 112, an adhesive component 124 that comprises a pressure sensitive adhesive (PSA) 125 and attaches to the mounting component preferably with hook and loop fasteners 122*a* and 124*a*, and a protective release liner 128 that cooperates with the adhesive component 124 to preserve the functionality of the adhesive 125 when it is not in use. The adhesive system 120 is configured such that an air channel 116 surrounds the adhesive system 120 and is defined by the outer edge 120*a* of adhesive system 120, the engagement surface 112*a* of the bulb cavity 112, and the release lip 114. Additionally, the adhesive system 120 is configured such that a light bulb 5 with an oddly shaped distal end 7 can protrude through openings 122*b* and 124*b* defined by the adhesive components 122 and 124 and, where needed, further protrude into a hollow cavity or channel or bore 106 defined by handle 104. Likewise, the adhesive system 120 cooperates with the hollow channel or bore 106 to also accommodate extended components of a broken bulb if the user wishes to use the gripping unit to remove broken bulbs. The articulating joint 30 comprises an articulating flexible knuckle arrangement configured to facilitate angled gripping applications. The extraction head 40 comprises a broken bulb configured to cooperate with a light bulb base cap. The modular and interchangeable components can be used together or individually depending on the location and type of bulb or application. The components are preferably combined in a kit to allow the user to easily interchange heads as needed. The components are further described in detail in the following sections.

Pole

An optional pole 20 cooperates with the attachment heads 100, the extraction head 40, and the articulating joint 30. Pole 20 can be an extended handle section, a fixed length pole, or an extendable telescoping pole. Pole 20 preferably includes attachment components that cooperate with attachment components of the attachment heads. For example, pole 20 may have external male threads 22 that cooperate with internal female threads of handle 104 of attachment head 100. Alternatively, pole 20 may have internal female threads (not shown) that cooperate with externally threaded handles 104 of attachment heads 100 or other attachment components as is known in the art. Pole 20 can be comprised of any rigid material capable of withstanding the weight of the attachment heads plus a light bulb and capable of withstanding repeated rotation by a user. Additionally, it can be manufactured from an insulating material to prevent electrical shock. Optional additional features of pole 20 comprises gripping or grasping groove, ridges, coatings, and grips.

Attachment Heads

In general, each attachment head 100 comprises a gripping unit 110 and a handle 104. Preferably, the gripping unit 110 and handle 104 are integrally formed. Alternatively, they can be two separate components that are attached together with any type of fastener, adhesive, or other connection means as is known in the art.

The preferred method of manufacture for the gripping unit and handle is through an injection molding process. However, other machining processes and methods can be utilized to accomplish the manufacture, but at a higher cost, longer led times, and increased base material cost. Injection molding materials suitable for the manufacture of this device/tool are classified into two primary base material categories of polymers, and one category of polyurethane resin counterpart. General grades include: acrylonitrile butadiene styrene, Acetal, styrene butadiene copolymer, polyamide or nylon 6/6, polyethelyene terephthalate, polypropylene, polyethylene styrene (crystal clear and opaque), and thermoplastic elastomers. Typical engineering grades include: a polycarbonate/acrylonitrile-butadiene styrene composite, polycarbonate, polyphenylene oxide/polyphenylene ether composite, polyethermide, thermoplastic polyetherimide, a polybutylene/terephalate composite), liquid crystal polymer, and polyphanylene sulfide. There are hundreds of possible urethane resin combinations available for combining with the injection molding base materials listed. Selections range from extremely soft-semi-flexible (less than 10 Shore A) to rigid (85 Shore D) in hardness. Custom materials are utilized to reinforce the strength, flexibility, durability, fracture and tear resistance. They are added into the matrix and cured in elongated strips, chopped small dimensioned media, or as an internal or surface applied woven textile. Custom materials include E or S-glass reinforcing media, carbon fiber reinforcing media, and polyamide reinforcing media.

Handle

Figure 7:
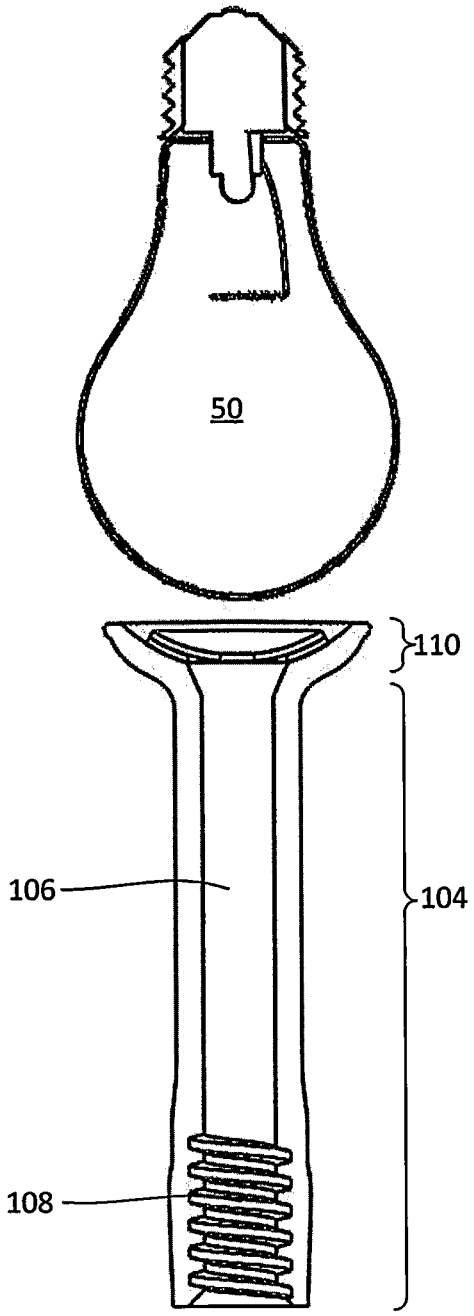
FIG. 7 is a cross-section view of the first platform attachment head shown in FIG. 6 and cut along the line VII-VII.
Figure 10:
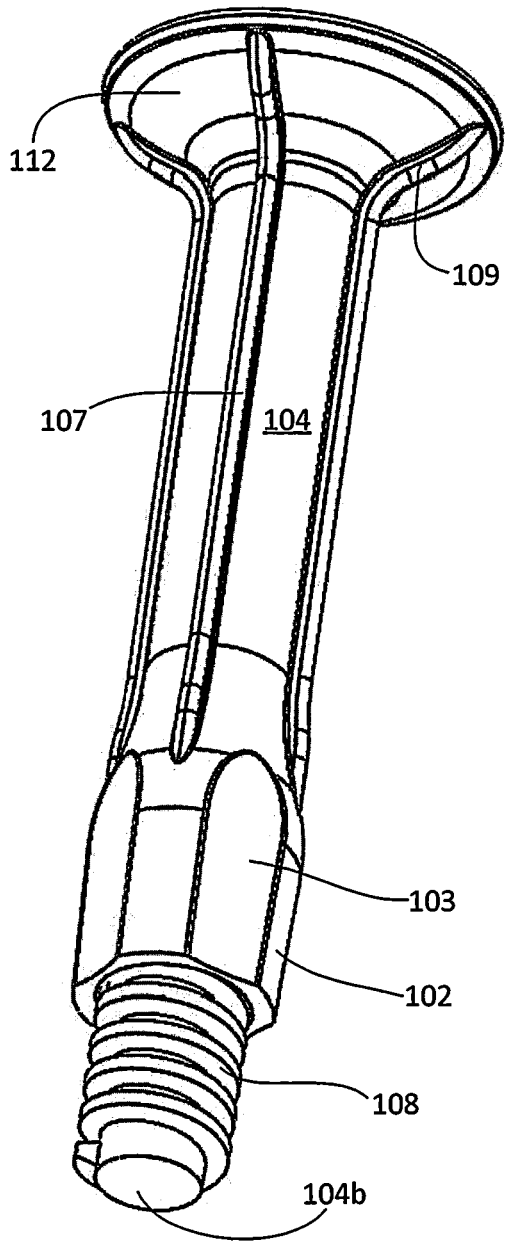
FIG. 10 is a perspective view of an alternative embodiment of the first platform attachment head of the present invention.
Figure 11:
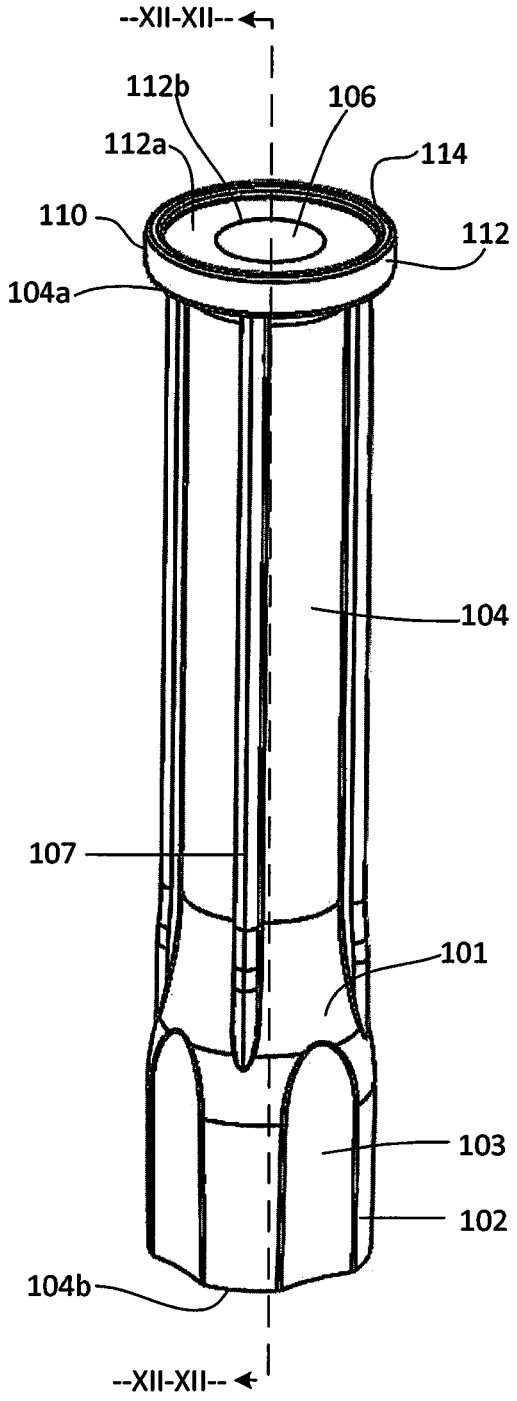
FIG. 11 is a perspective view of a second platform attachment head according to the present invention.

Attachment head handle 104 comprises a distal end 104*a* that cooperates with the gripping unit 110 and a proximal end 104*b* that cooperates with an optional pole 20. Handle 104 generally has a circular cross-section, however it can have a triangular, rectangular, irregular, or any other shaped cross-section and still fall within the scope of the present invention. Handle 104 further comprises a longitudinal bore, channel, or hollow cavity 106 that preferably extends along the central axis of handle 104 from its proximal end 104*b* to its distal end 104*a*. Near the distal end 104*a* of the handle 104, the bore preferable tapers from a wider circumference where it meets with gripping unit 110 to a narrower circumference as shown in the Figures. Bore 106 preferably extends along the entire central axis of handle 104 to both accommodate additional features of the handle and to increase manufacturing efficiency and throughput for the injection molding process of manufacturing. Alternatively, handle 104 can comprise one or more hollow cavities located along the central axis. Near the proximal end 104*b* of handle 104, handle 104 comprises an attachment end 102 that comprises fasteners or attachment components to facilitate cooperation with an optional extension pole 20. Preferably, the attachment components comprise internal female threads 108 along bore 106 as shown in FIG. 7 that are configured to cooperate with external threads on pole 20. Alternatively, the attachment components comprise external male threads around the outer circumference of handle 104 as shown in FIG. 10 that are configured to cooperate with female threads on pole 20. Additional optional attachment components comprise tension screws, collar arrangements, push-button tension arrangements, or any other means of rigidly and fixedly attaching two components together as is known in the art.

Additional optional features of handle 104 include gripping ridges 107 spaced along the outer surface of handle 104, reinforcements or support braces 109 spaced along an outer ramped section 105 of the outer surface of handle 104 near its distal end 104*a*, and gripping recesses 103 at the attachment section 102 of handle 104 at its proximal end 104*b*. Gripping ridges are configured to increase a user's grip on the handle and to facilitate rotation of the handle when in use. Gripping ridges 107 are preferably integrally formed with handle 104 or optionally are separate components that are fixedly attached to handle 104 with fasteners, adhesives, or any other means of fixedly attaching two components. Gripping ridges may comprise materials similar to handle 104 or may comprise materials designed to increase one's grip of a handle such as rubber or other suitably tacky materials. Additionally, gripping ridges 107 preferably extend longitudinally along handle 104, extend radially outward from the center of handle 104, and are preferably spaced at equal distances around the outer surface of handle 104 as shown in FIGS. 6, 8, and 10.

Figure 6:
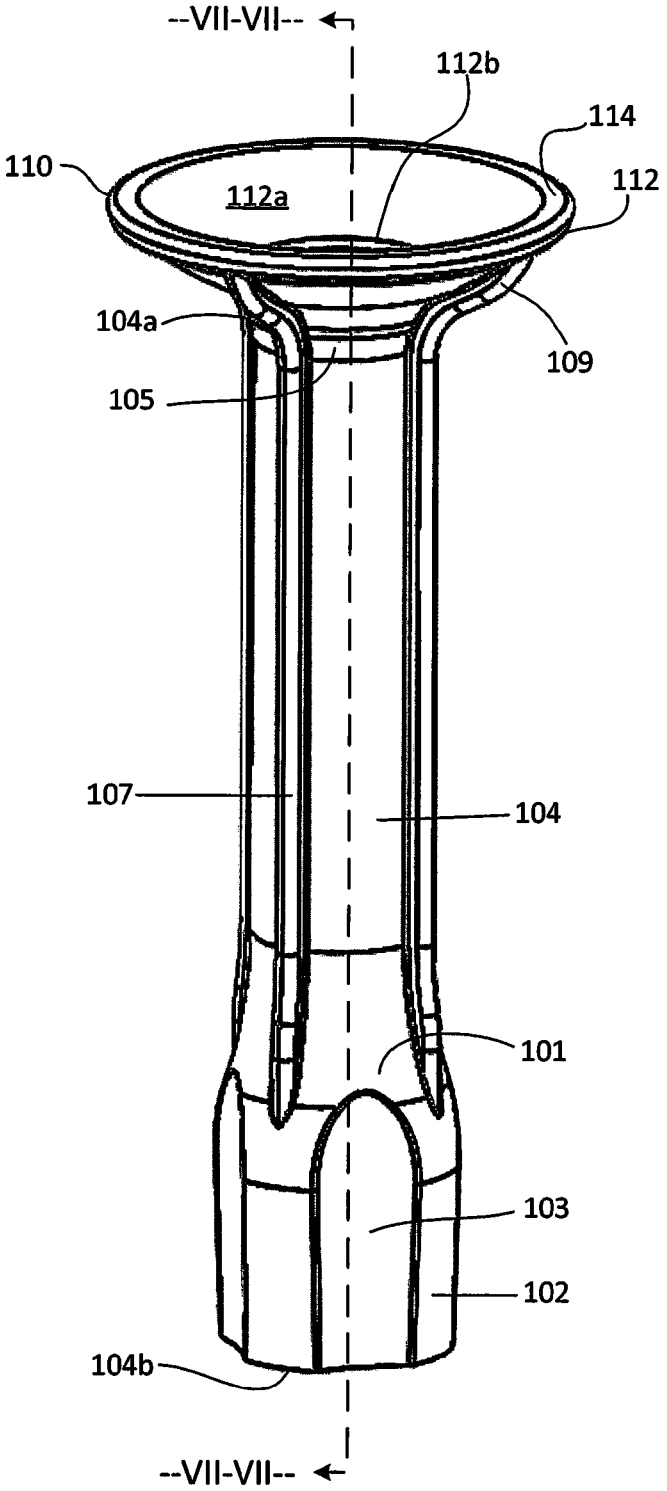
FIG. 6 is a perspective view of a first platform attachment head according to the present invention.
Figure 8:
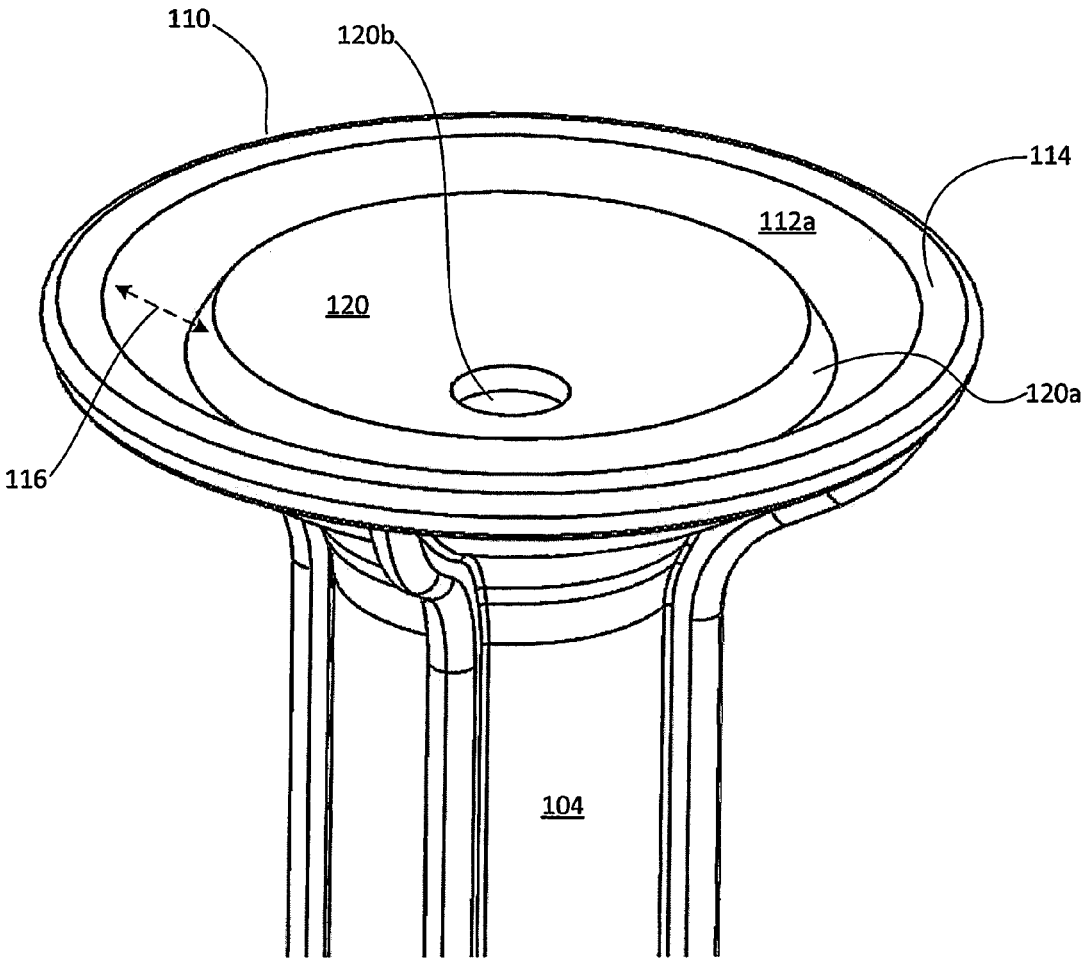
FIG. 8 is a perspective view of the distal end of the first platform attachment head according to the present invention.
Figure 9:
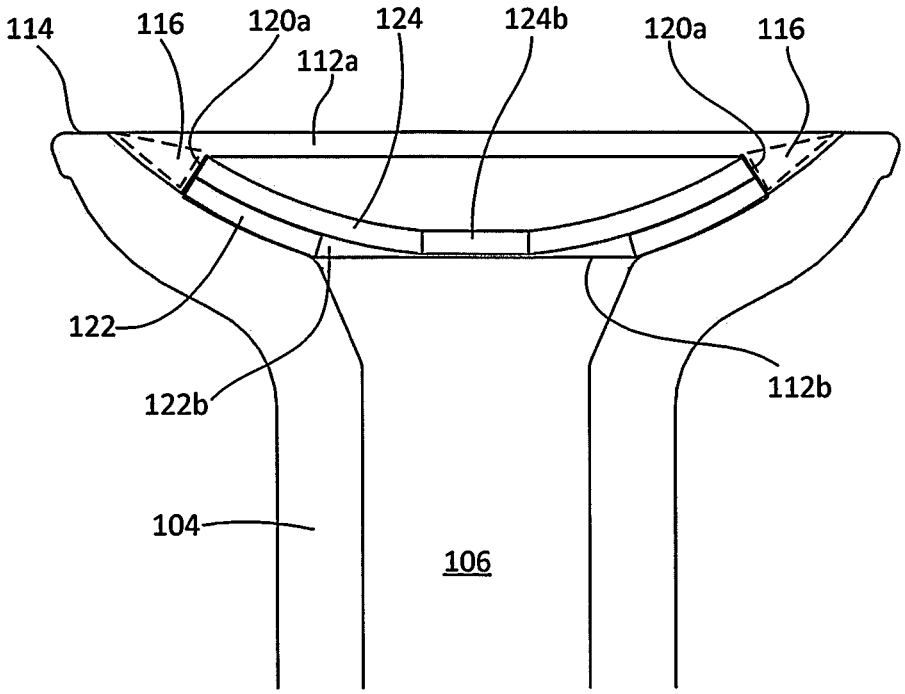
FIG. 9 is a schematic side view of the distal end of the first platform attachment head according to the present invention.

Support braces 109 are preferably spaced at equal distances along the outer ramped section 105 of handle 104 as shown in FIGS. 6, 8, and 10. Support braces preferably are integrally formed with handle 104 and serve to provide additional support for the attached or integral gripping unit 110. The outer ramped section 105 also further serves to increase the thickness of the handle near the gripping unit to provide increased circumferential support for the gripping unit.

Gripping recesses 103 at the attachment end 102 of handle 104 are optional and configured to further facilitate gripping the handle 104 and rotating the handle 104. Gripping recesses 103 are preferably integrally formed with the handle 104 as shown in FIG. 6. An optional ramped section 101 of handle 104 creates the transition between the main body of handle 104 and the attachment end 102.

Overall, handle 104 is configured to be long enough to accommodate both smaller hands and larger hands of various users and is configured with an outer circumference also sized to accommodate both larger and smaller hands. Preferably, the overall length of the entire attachment head is five inches as measured from release lip 114 to the proximal end 104*b*.

Gripping Unit

Each gripping unit 110 comprises a geometry designed to cooperate with one or more light bulbs or categories of light bulbs and to cooperate with the attached handle 104. Several embodiments of gripping units 110 are described in detail below. Each gripping unit is designed for installation and removal of light bulbs and, additionally, each gripping unit and in particular the first embodiment of the gripping unit can be used to remove broken light bulbs as well. Each gripping unit also includes an adhesive system 120 that is designed to adhere to a light bulb during installation and removal and to easily separate from the light bulb after installation or removal is complete. The adhesive unit 120 is preferably permanently mounted on the bulb cavity engagement surface 112*a* the bulb cavity 112 of gripping unit 110.

Adhesive System

Figure 3:
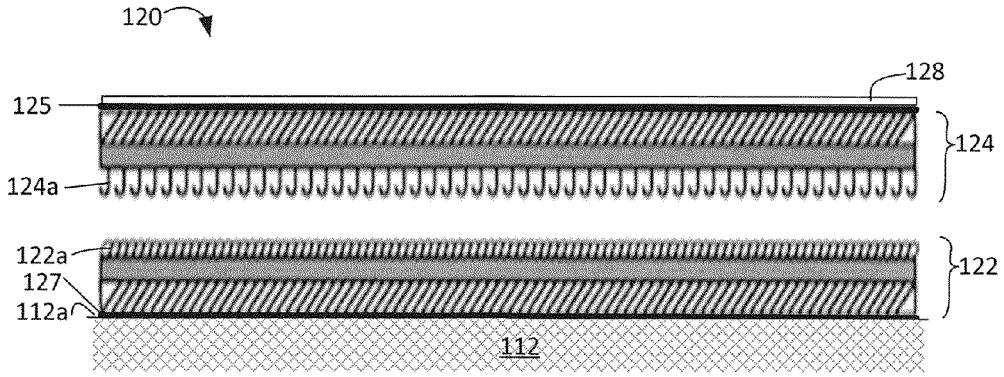
FIG. 3 is an illustration of the adhesive system components of the present invention.
Figure 4:
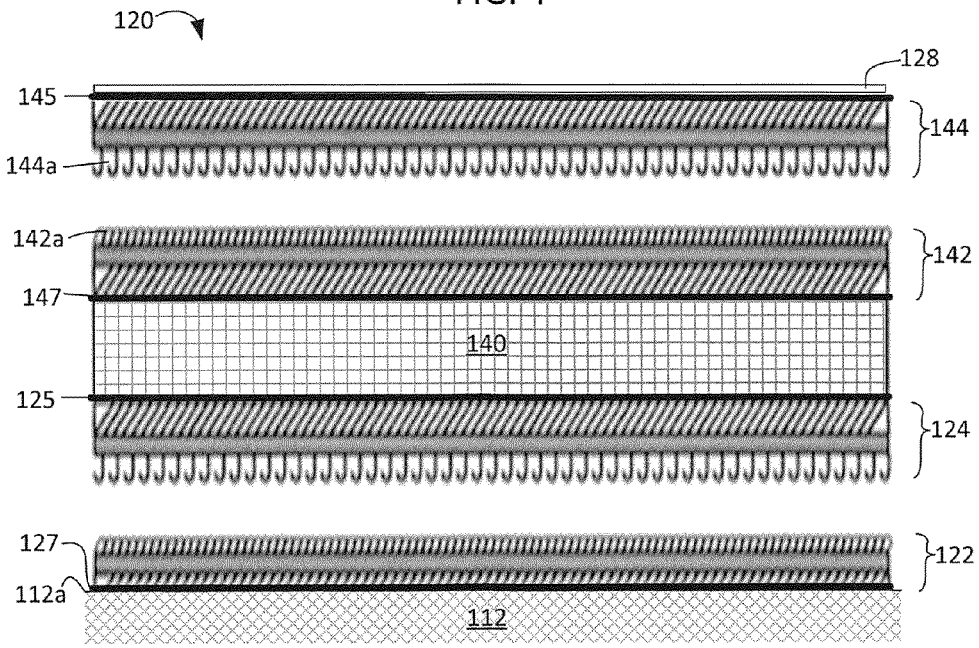
FIG. 4 is an illustration of an alternative embodiment of the adhesive system components of the present invention.
Figure 5:
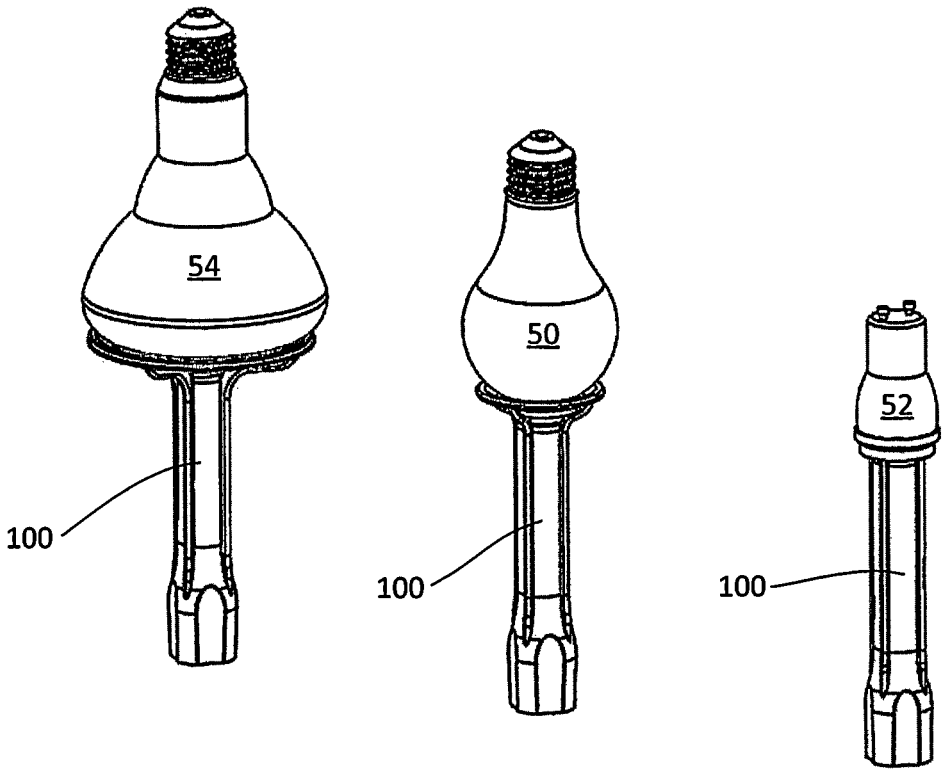
FIG. 5 is an illustration of three embodiments of attachment heads according to the present invention.

Adhesive system 120 comprises multiple cooperating components designed to adhere to and to maximize the surface area for adhering to a light bulb and has an overall edge of 120*a*. Preferably, adhesive system 120 components are cooperating hook and loop type fasteners. FIGS. 3 and 4 magnified views of two embodiments of the adhesive system.

Adhesive system 120 comprises a mounting component 122 having a loop fastener 122*a*, an adhesive component 124 having a hook fastener 124*a*, bulb adhesive 125, optional mounting adhesive 127, and an optional but preferably release liner 128 as shown in FIG. 3. Alternatively, mounting component 122 may have a hook fastener, and adhesive component 124 may have a loop fastener as long as mounting component and adhesive component cooperate. Mounting component 122 preferably attaches to a bulb cavity engagement surface 112*a* of the gripping unit 110 with mounting adhesive 127. Alternatively, it can attach to gripping unit 110 with other means such as screws and nuts, snaps, stitches, or any other method of attaching two components. Hook and loop fasteners and optional alternatives to hook and loop fasteners that are suitable for the present invention are described in general below.

The adhesive component 124 of adhesive system 120 includes bulb adhesive 125 on its exposed edge. Bulb adhesive 125 is preferably a pressure sensitive adhesive (PSA) as detailed below. To preserve the adhesion characteristics of bulb adhesive 126, release liner 128 readily attaches and releases to prevent degradation from air and other contaminants.

FIG. 4 illustrates an alternative embodiment of adhesive system 120 comprising two adhesive components 124 and 144, two mounting components 122 and 142, a spacer 140, and a release liner 128. As shown, a first mounting component 122 is mounted on the engagement surface 112*a* of bulb cavity 112 preferably with mounting adhesive 127. First mounting component 122 and first adhesive component 124 cooperate with hook 124*a* and loop 122*a* fasteners. First adhesive component 124 further includes first bulb adhesive 125 to which one surface of spacer 140 adheres. Second mounting component 142 is mounted to a second surface of spacer 140 preferably with mounting adhesive 147. Second mounting component 142 and second adhesive component 144 cooperate with hook 144*a* and loop 142*a* fasteners. Second adhesive component 144 further includes second bulb adhesive 145 to which the release liner 128 adheres. The spacer 140 further enhances the adhesive system 120 by allowing additional flex and allowing the adhered 145 to wrap up against the light bulb to increase the adhesion area. Further, this allows for an increased uniform distribution area for the torque and tension required to remove or install even the most difficult fitting bulbs, without the typical pressure applied build-up in a non-uniform distribution as achieved from the five categories of prior art.

Hook and Loop Fasteners:

Hook-and-loop fasteners generally are re-closable fastener systems consisting of two components that provide a thin, pliable, temperature resilient, and multiple width & peel strength capable two-part closure system. The first component features tiny hooks, and the second component features even smaller loops. When the two components are pressed together, the hooks catch in the loops and the two pieces fasten or bind temporarily during the time that they are pressed together. Hook and loop fasteners are comprised from filamentary stress-bearing hooks and loops, and both the hook and loop components are secured with a resinous thermoplastic composite system which adds strength and durability to the textile components of the two part fastener system. Hook and loop fastener systems are comprised from various materials such as textiles, polymers and metals, and the design of the hook and loop individual connecting constituent components has variations. Hook and loop fasteners include the three primary designs of standard hooks (designed for medium peel and shear applications), dual hooks (designed for high peel and shear applications), and micro hooks (designed for high shear applications with very small hooks).

Alternative two-component or re-closable fasteners that can be used for the present invention include post-and-socket designs, clip-and-snap receiver designs, and polymer tape systems or hybridized configurations incorporating textiles, metallic and polymer materials. Finally, rigid polymer injection molded hook and loop, and dual hook, post configured fastener systems can also be used for the present invention where flexibility is not a prerequisite, but where a quick disconnecting and connecting fastener system is required. Just as in the flexible hook and loop or dual hook or post systems, polymer tape systems the components are manufactured from a wide range of polymer/plastic resins such as polypropylene, high-density or low-density polyethylene, polyoxymethylene, acetal homo polymer and copolymer, Nylon PA6 and PA6.6 polyamids, and other thermoplastic elastomers.

Pressure Sensitive Adhesives:

Pressure sensitive adhesives (PSA) are adhesives that adhere to a variety of substrates when applied with pressure and that adhere by polar attraction to the substrate surface rather than requiring heat, water or a solvent to initiate a bond. Typically, PSAs comprise a fluid, adhesive micro-web and a structured backing and use an elastomer as the primary base material, which can be any one of the following materials: natural rubber, vinyl ethers, acrylics, butyl rubber, styrene block copolymers, silicones and nitriles. To increase adhesion of the PSA, the base material is combined with a tackifier, such as terpenes, aromatic resins, hydrogenated hydrocarbon resins and terpene-phenol resins. For the present invention, it is desirable to have PSAs that semi-permanently adhere to a light bulb, separate quickly and cleanly without residual adhesive remaining on the bulb, and maintain cohesion so that they do not tear apart during removal of a bulb. More preferably, it is desirable to have PSAs comprising water based acrylic adhesives. They are manufactured with the adhesive polymer being suspended in water prior to being cured with heat. This type of adhesive can withstand increased moisture and has higher heat resistant temperature resistance as compared to rubber based adhesives, and have greater resistance to breaking down (degradation) than rubber based adhesives.

Spacer: The spacer 140 can comprise polychloroprene, synthetic rubber, or other suitable resilient and compressible material. The spacer is provided to distribute a uniform amount of adherend surface onto the specific shape of any light bulb. Resilience (also known as rebound) refers to a compound's ability to regain its original size and shape following temporary deformation. Allowing the flexibility of the resilient and compressible spacer to flex and allow the adhered to wrap up against the bulb allows for increased adhesion area which allows for an increased uniform distribution area for the torque and tension required to remove or install even the most difficult fitting bulbs, such as long tapered pointed distal ended bulbs, without the typical pressure applied build-up in a non-uniform distribution as achieved from the five categories of prior art.

First Embodiment of Gripping Unit

FIGS. 6-10 illustrate the first embodiment of the gripping unit 110, which cooperates with at least traditional incandescent bulbs 50. Gripping unit 110 attaches to or is integral with handle 104 at its distal end 104*a*. Gripping unit comprises a platform or bulb cavity 112 having an engagement surface 112*a* on which the adhesive system 120 attaches. Bulb cavity 112 and engagement surface 112*a* further define an opening

112*b* that cooperates with and is in fluid communication with the bore 106 defined by handle 104. Preferably, the bulb cavity 112 is generally concave in shape with a substantially flat release lip 114 around its circumference as shown in the Figures. Adhesive system 120 covers less than all of the engagement surface 112*a* such that an air channel 116 is defined by the outer edge 120*a* of adhesive system 120, the exposed surface area of the engagement surface 112*a*, and the release lip 114 of the bulb cavity.

The air channel 116 is configured such that its size and shape combined with release lip 114 facilitate release of the light bulb from the bulb adhesive 125 of the adhesive system 120 after a bulb has been removed from or installed in a light fixture. For example, air channel 116 and release lip 114 together provide a flat planar surface and an area of air exposure so that the contact area between the light bulb and adhesive system is reduced, the interactive force between the adhesive and light bulb glass substrate is reduced, and the substrate surface energy is reduced. To remove a light bulb from the adhesive system 120 and gripping unit 110, the gripping unit 110 is tilted slightly in any direction until the light bulb makes contact with the release lip 114. Then, by applying slight pressure and a turning or rotational force at the same time, the adhesive is released without the need to pull against the full adhesion properties of the adhesive. The removal leaves no residual adhesive material on the exterior of the light bulb with the release is completed in this manner.

For the first embodiment of the gripping unit, the diameter of the overall bulb cavity engagement surface 112*a* plus release lip 114 is preferably about 2 inches. Additionally, the release lip 114 further comprises a beveled outside edge (not labelled) to facilitate the injection molding process and to avoid sharp edges. The adhesive system 120 is preferably circular in shape and further defines a preferably circular opening 120*b* at the center of each of its components. Further, it is preferable that circular opening 120*b* comprise a first opening 122*b* defined by the mounting component 122 that is sized slightly larger in diameter than a second opening 124*b* defined by the adhesive component 124. Preferably, the openings 122*b* and 124*b* range in size between 0.25 inches and 0.875 inches.

The adhesive system openings 122*b* and 124*b* cooperate with and are in fluid communication with the opening 112*b* defined by the bulb cavity and the bore 106 of the handle. Together, the adhesive system openings 122*b* and 124*b*, bulb cavity opening 112*b*, and tapered end of bore 106 provide accommodations for light bulbs with extended tips or unusually shaped tips such as flame tips, candle tips, or pointed bulbs. Additionally, they together accommodate broken bulbs such that the extended portions of a broken bulb can protrude into channel or bore 106 while the adhesive cooperates with the base of the broken bulb. Bulbs designed to resemble candle flames, or pointed bulbs with elongated tapered bulbs with thin small distal pointed ends benefit also from the increased elasticity afforded by the openings defined by the adhesive system. In particular, the tapered end of bore 106 facilitating cooperation with the usually angled ends of pointed or tapered bulbs. The angled ends often are offset from the longitudinal axis of the bulb and therefore require a larger cooperating bore 106. Additionally, the two components 122 and 124 of the adhesive system allow for the pointed and elongated ends to pass through and permit the adhesive component 124 to flex downward into the larger opening 122*b* of the mounting component 122, which maximizes the flexibility and interconnection of the hooks and loops of the adhesive components 120 and allows the bulb adhesive to engage a larger portion of the small light bulb tip. Additionally, an optional second adhesive system 120 and spacer 140 as shown in FIG. 4 allows for even further accommodations.

The radius required to maintain an appropriate contact angle between the bulb adhesive and the light bulb surface is a function of both dispersive adhesion (the interaction between the molecules in the adhesive and those of the solid) and the cohesion within the adhesive. An appropriate contact angle can only be achieved through establishing a concaved radius that is predicated upon the external distal regions of any given light bulb type. This is also due to the flattened surface of the exposed adhesive that will be in contact with the glass or polymer material of the light bulb. A small contact angle indicates more adhesion is present as there is a large contact area between the adhesive and the substrate, accomplished by a uniform radius matching that of any specific external light bulb distal proportions, which will result in a greater overall substrate surface energy and high interactive force between the adhesive and the substrate. The approximate radius variance ranges from 13 light bulbs having a classic shape are between 1.35 inches for adhesive component 124 and 1.29 inches for the engagement surface 112*a* of the concaved bulb cavity 112*a*. In one embodiment, the acceptable nominal median radius of 1.24 inches for adhesive component 124 and 1.19 inches for the engagement surface 112*a* of the concaved bulb cavity 112*a*, accounting for the minimal allowance in the resilient compression set within the hook and loop intersection connection point, for the rigid outermost hook-n-loop adhesive bulb removal system.

Figure 2:
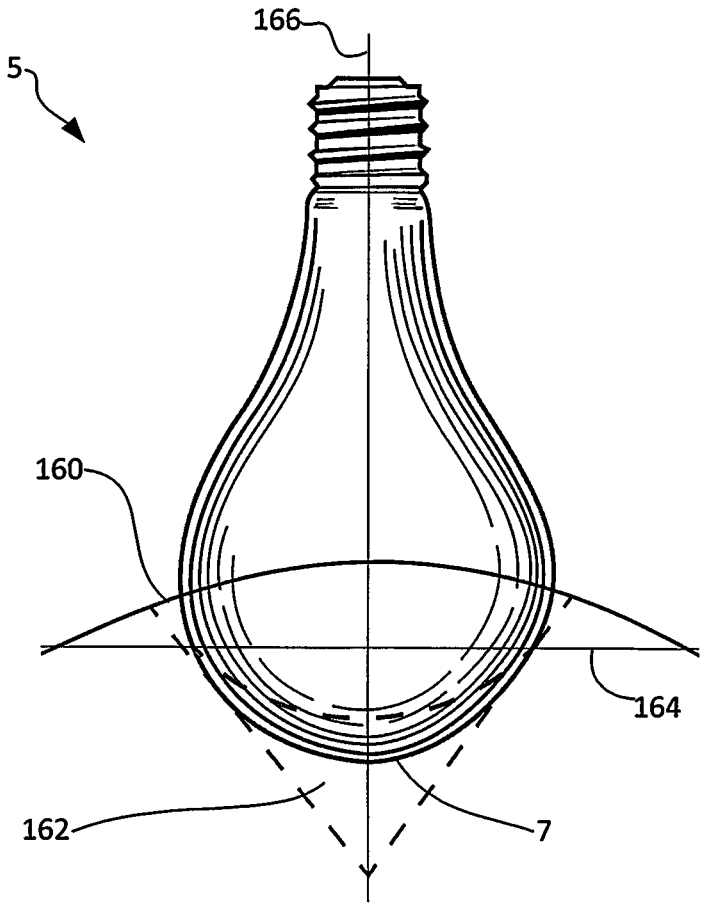
FIG. 2 is an illustration of the preferred contact region of an incandescent light bulb for purposes of cooperating with an attachment head of the present invention.

Classic light bulbs include incandescent bulbs, fluorescent twisted tubes encased within a glass or polymer exterior surround, or light emitting diode (LED) based units within a glass or polymer exterior surround. A classic style light bulb is shown in FIG. 2 as well as the arc radius regions defining the relative adhesion contact angle region circumferentially around the distal end of the light bulb. This is used to demonstrate the relative radius arc requirements for obtaining the sufficient amount of substrate surface and contact angle to achieve proper semi-permanent adhesion to the distal end of the light bulb. The upper arc radius 160 is predicated upon the external dimensions of each specific light bulbs distal region measured at its broadest horizontal axis point 164 relative to its vertical axis 166 when positioned with the light bulbs base cap at the top as suspended downward from an overhead position. The area 162 within the section formed by the upper concave line and the two diagonal dashed lines intersecting at the longitudinal vertical axis 166 and the horizontal axis 164, represent the maximum region for the greatest amount of light bulb substrate surface, and defines the a suitable radius for the gripping unit bulb cavity inner surface 112*a*, to establish a proper contact angle for the adhesive contact region circumferentially around the distal end of each specific light bulb configuration.

Second Embodiment of Gripping Unit

Figure 12:
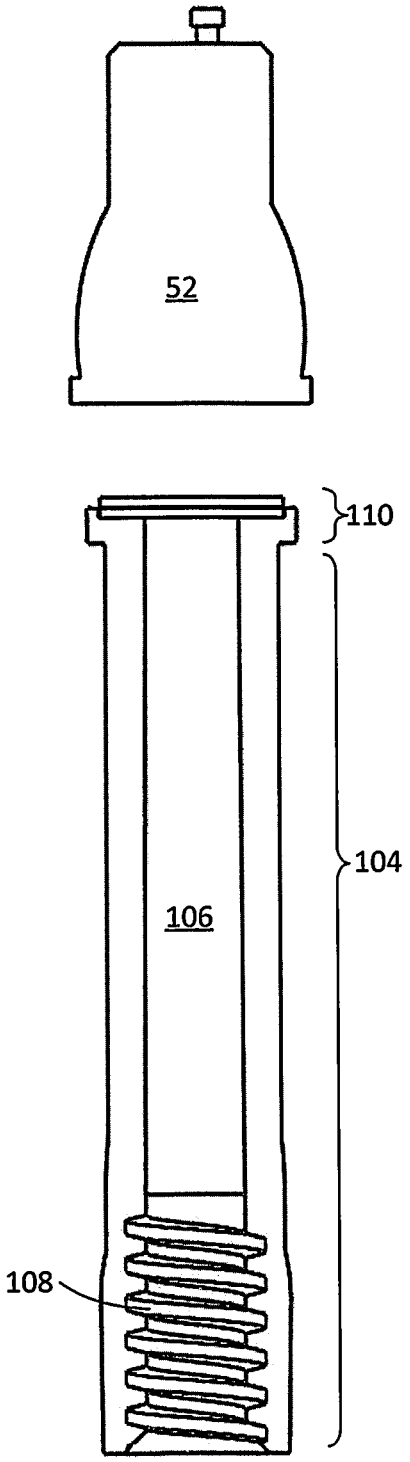
FIG. 12 is a cross-section view of the second platform attachment head shown in FIG. 11 and cut along the line XII-XII.
Figure 13:
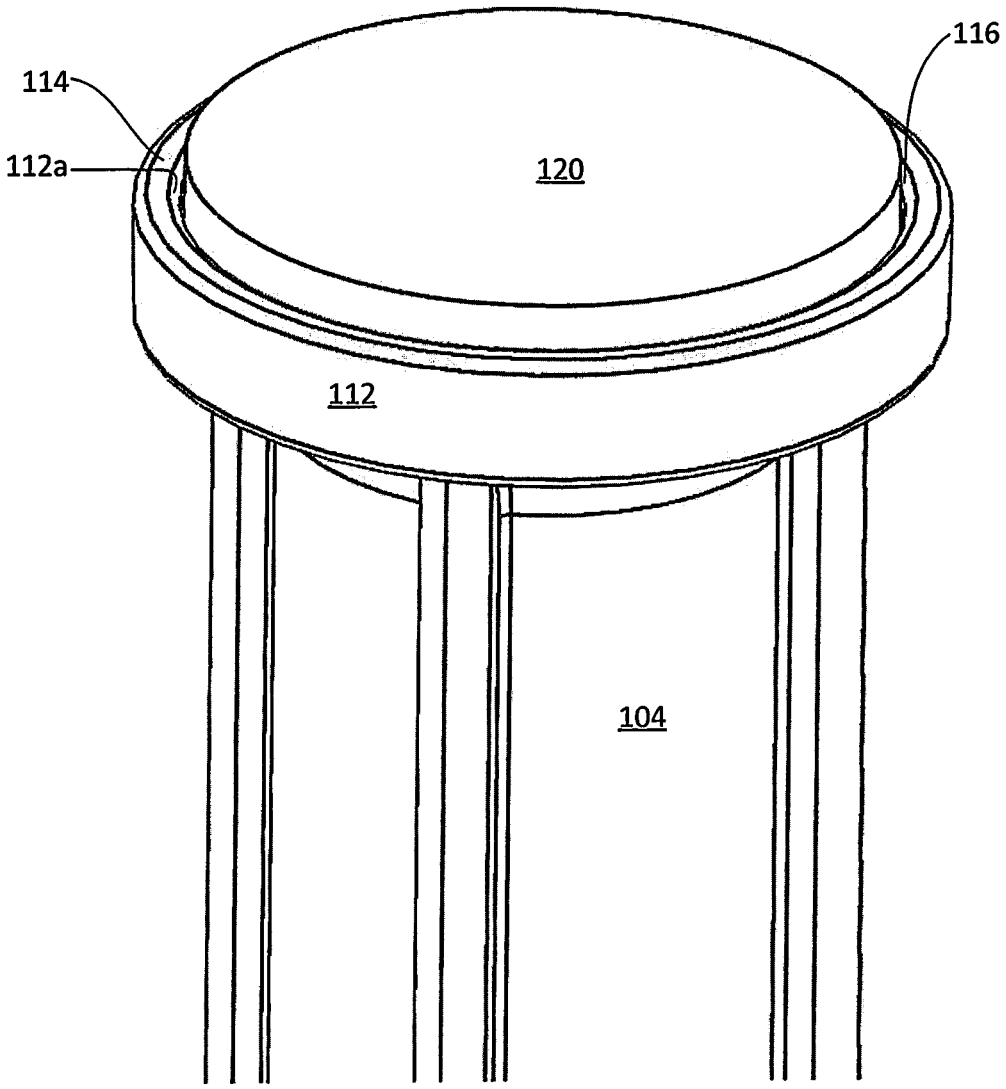
FIG. 13 is a perspective view of the distal end of the second platform attachment head of the present invention.
Figure 14:
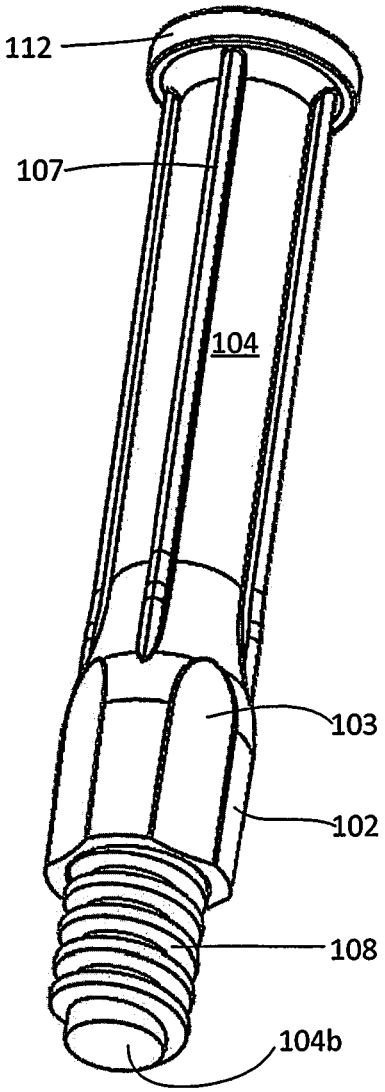
FIG. 14 is a perspective view of an alternative embodiment of the second platform attachment head of the present invention.
Figure 15:
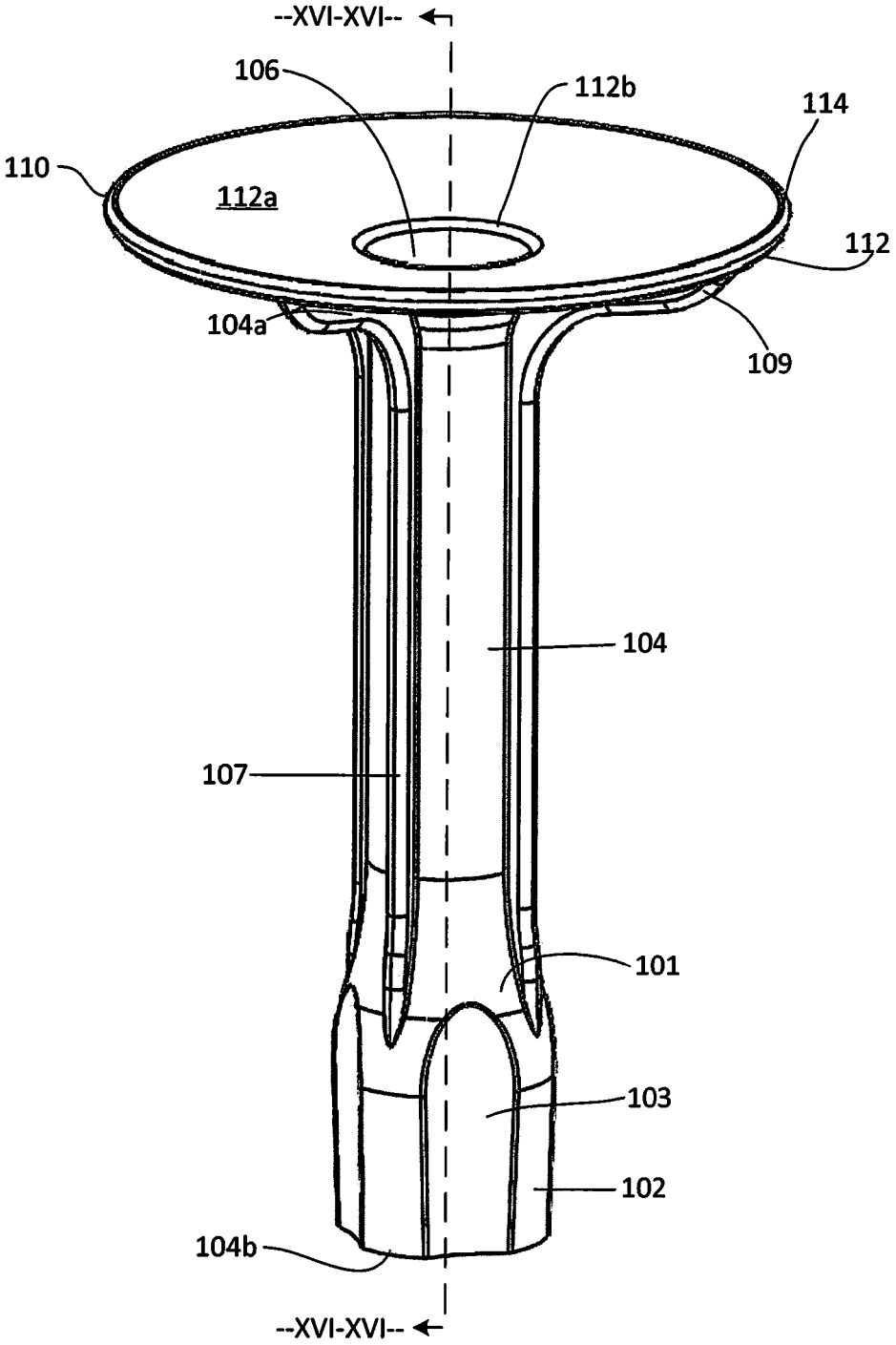
FIG. 15 is a perspective view of a third platform attachment head according to the present invention.
Figure 16:
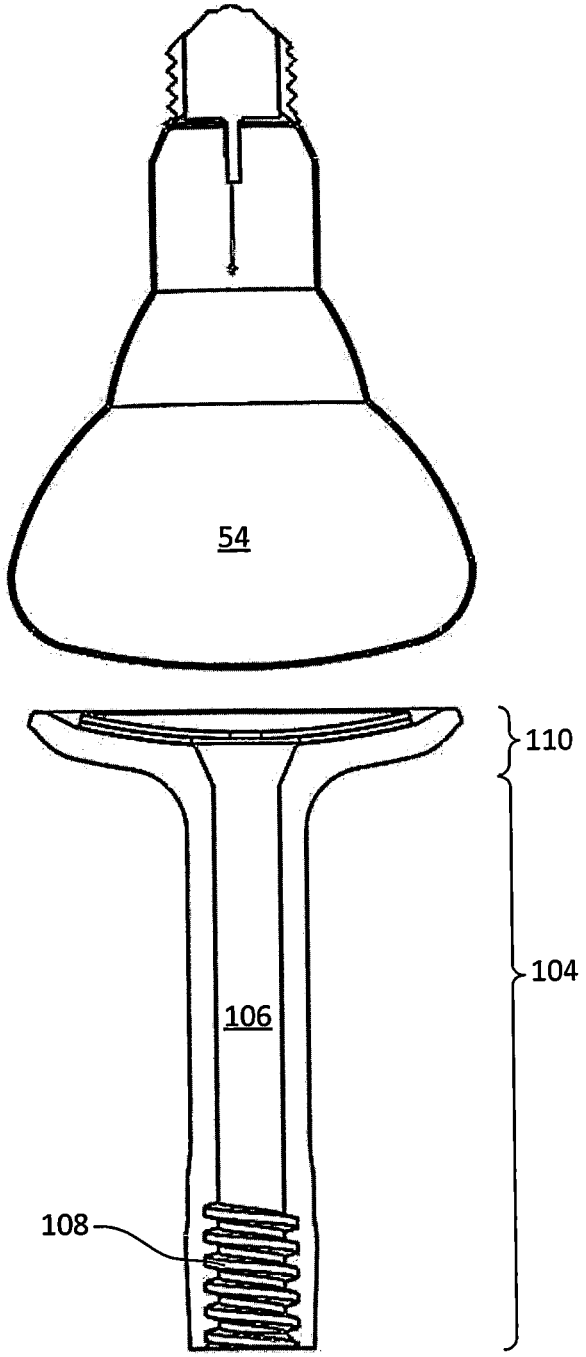
FIG. 16 is a cross-section view of the third platform attachment head shown in FIG. 15 and cut along the line XVI-XVI.
Figure 17:
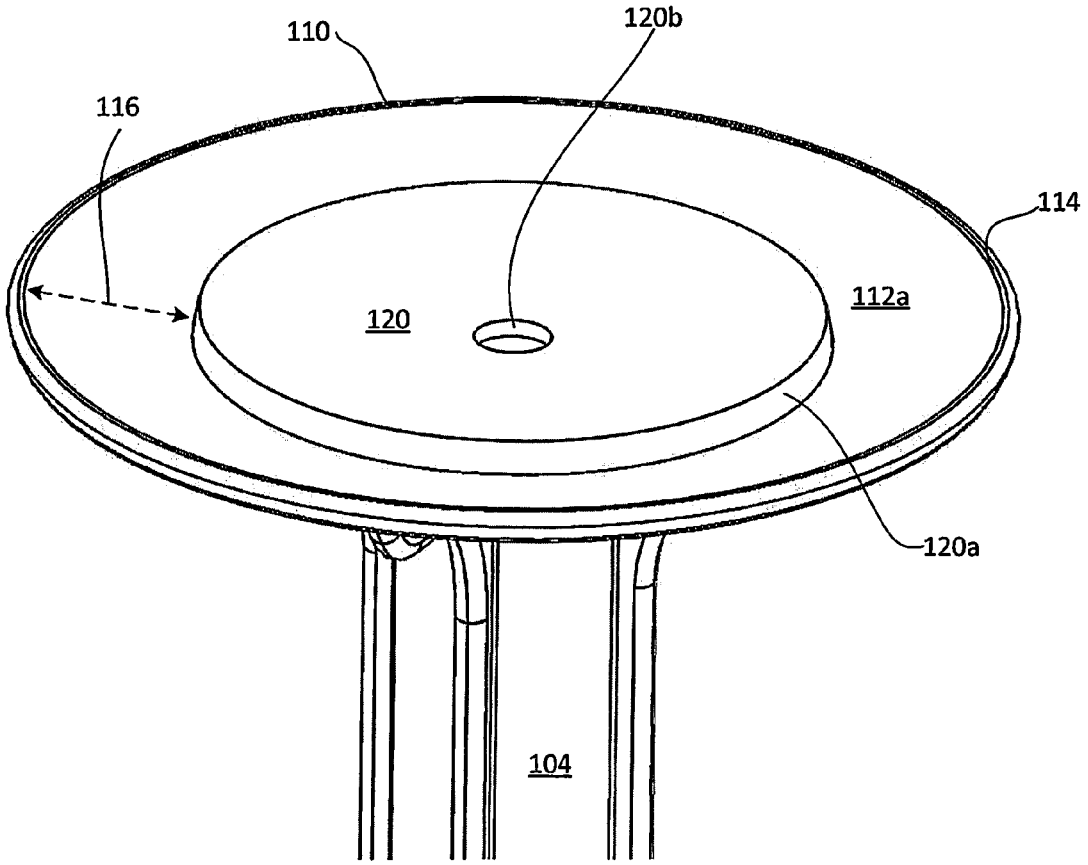
FIG. 17 is a perspective view of the distal end of the third platform attachment head of the present invention.
Figure 18:
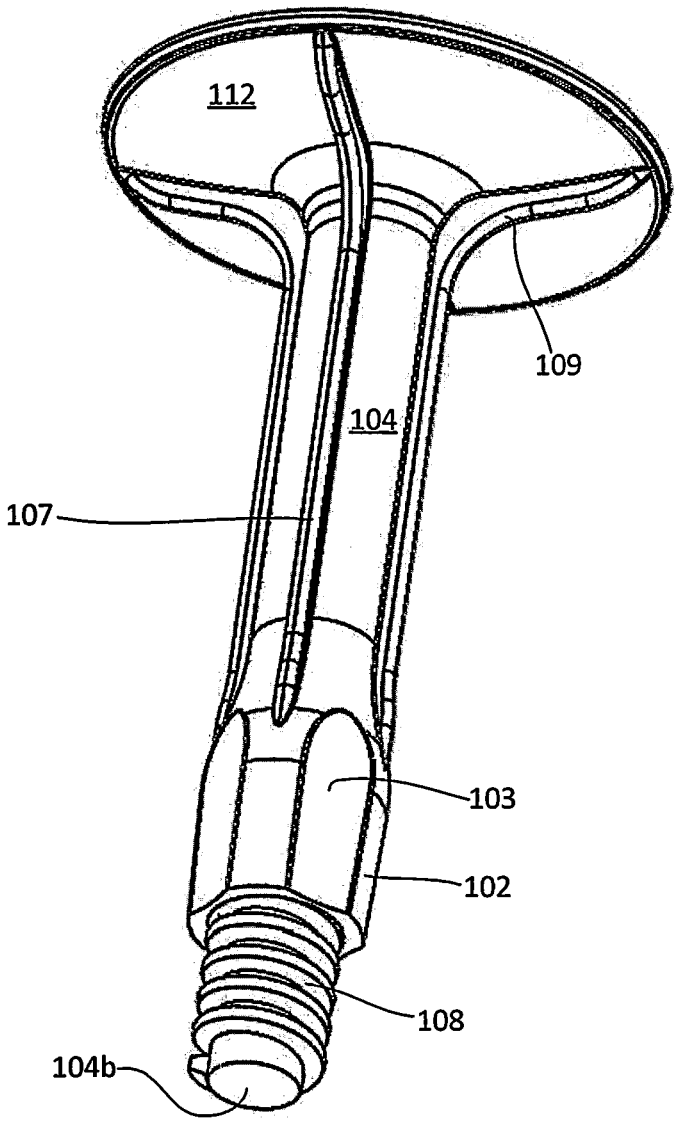
FIG. 18 is a perspective view of an alternative embodiment of the third platform attachment head of the present invention.

FIGS. 11-14 illustrate the second embodiment of the gripping unit, which cooperates with smaller bulbs such as mini spotlight bulbs 52. Generally, the second embodiment of the gripping unit is configured like the first gripping unit but with slightly smaller dimensions to accommodate smaller light bulbs and a flat or substantially flat bulb cavity engagement surface 112*a*. In particular, the diameter of the overall bulb cavity engagement surface 112*a* plus release lip 114 is preferably about 1.125 inches. Additionally, the adhesive system 120 is preferably circular in shape and optionally further defines a circular opening at the center of each of its components. Further, it is preferable that the opening 122*b* defined by the mounting component 122 is sized slightly larger in diameter than the opening 124*b* defined by the adhesive component. Preferably, the openings 122*b* and 124*b* range in size between 0.25 inches and 0.3125 inches for the second embodiment of the gripping unit. Alternatively, the adhesive system 120 can be present without any opening 120*b* as shown in FIGS. 12 and 13.

The radius required to maintain an appropriate contact angle between the bulb adhesive and the light bulb surface for the second embodiment of the gripping unit was determined from 11 light bulb having a basic mini spot shape, which includes both incandescent light bulbs and light emitting diode based units within a glass or polymer exterior surround. The radius comprises approximate radius variance ranges between 0.195 inches for adhesive component 124 and 0.0635 inches for the engagement surface 112*a* of the concaved bulb cavity 112*a*. In one embodiment, the acceptable nominal median radius of 0.0018 inches for adhesive component 124 and 0 inches for the engagement surface 112*a* of the concaved bulb cavity 112*a*, accounting for the minimal allowance in the resilient compression set within the hook and loop intersection connection point, for the rigid outermost hook-n-loop adhesive bulb removal system.

Third Embodiment of Gripping Unit

FIGS. 15-18 illustrate the third embodiment of the gripping unit, which cooperates with larger light bulbs such as those used with flood lights 54. Generally, the third embodiment of the gripping unit is configured like the first and second gripping units but with larger dimensions to accommodate larger light bulbs. In particular, the diameter of the overall bulb cavity engagement surface plus release lip is preferably about 3.50 inches. Additionally, the adhesive system 120 is preferably circular in shape and further defines a preferably circular opening at the center of each of its components. Further, it is preferable that the opening 122*b* defined by the mounting component 122 is sized slightly larger in diameter than the opening 124*b* defined by the adhesive component. Preferably, the openings 122*b* and 124*b* range in size between 0.25 inches and 0.875 inches for the second embodiment of the gripping unit.

The radius required to maintain an appropriate contact angle between the bulb adhesive and the light bulb surface for the third embodiment of the gripping unit was determined from 11 light bulbs having a basic flood shape, which includes both incandescent light bulbs and light emitting diode based units within a glass or polymer exterior surround. The radius comprises approximate radius variance ranges between 5.85 inches for adhesive component 124 and 5.55 inches for the engagement surface 112*a* of the concaved bulb cavity 112*a*. In one embodiment, the acceptable nominal median radius of 5.75 inches for adhesive component 124 and 5.64 inches for the engagement surface 112*a* of the concaved bulb cavity 112*a*, accounting for the minimal allowance in the resilient compression set within the hook and loop intersection connection point, for the rigid outermost hook-n-loop adhesive bulb removal system.

Fourth Embodiment of Gripping Unit

Figure 23:
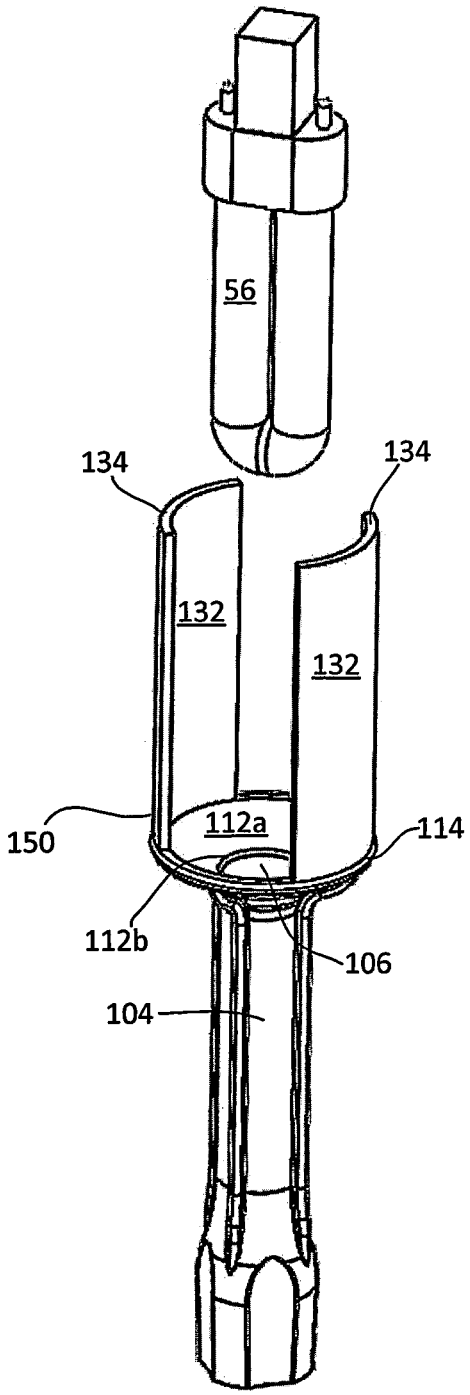
FIG. 23 is a perspective view of an alternative attachment head with two extensions according to the present invention.

FIG. 23 illustrates the fourth embodiment of the gripping unit 150, which cooperates with traditional fluorescent type light bulbs and is a modified version of the first embodiment of griping unit 110. The overall height of the attachment head comprising the fourth embodiment of the gripping unit 150 is approximately 10 inches, which includes the handle section 104 and gripping unit 150. The fourth embodiment of gripping unit 150 is similar to the first embodiment of gripping unit 110 and comprises the features of the first embodiment of gripping unit 110 and preferably comprises the adhesive system 120 as detailed with respect to the first embodiment. Additionally, the fourth embodiment of gripping unit further comprises one or more extensions 132 extending from release lip 114 as shown in FIG. 23. Preferably, gripping unit 150 comprises two diametrically opposed extensions 132, and preferably each extension 132 is curved such that it has a radius equal in dimension to the total outside diameter of release lip 114 and bulb cavity engagement surface 112*a* to accommodate sets of linear and twisted fluorescent light bulbs. In one embodiment that dimension would be 2.00 inches for the larger diameter twisted and 3 to 4 linear tube fluorescent light bulb arrangements. In another embodiment that dimension would be 1.125 inches for the small diameter single and double linear tube fluorescent light bulb arrangements. Extensions 132 preferably extend substantially vertically from release lip 114 or optionally extend vertically with a slight taper radially inward to provide increased pressure against the bulb at extension ends 134 and to provide increased total support along the entire length of the extension 132. Optionally, extensions 132 may further include an internally attached reversed flexible hinged tension flap starting just below extension end 134 to provide a tighter pressure at the extension end 134 of the longer fluorescent linear tube light bulbs in addition to the support along the entire length of the extension 132.

Extraction Head

Figure 19:
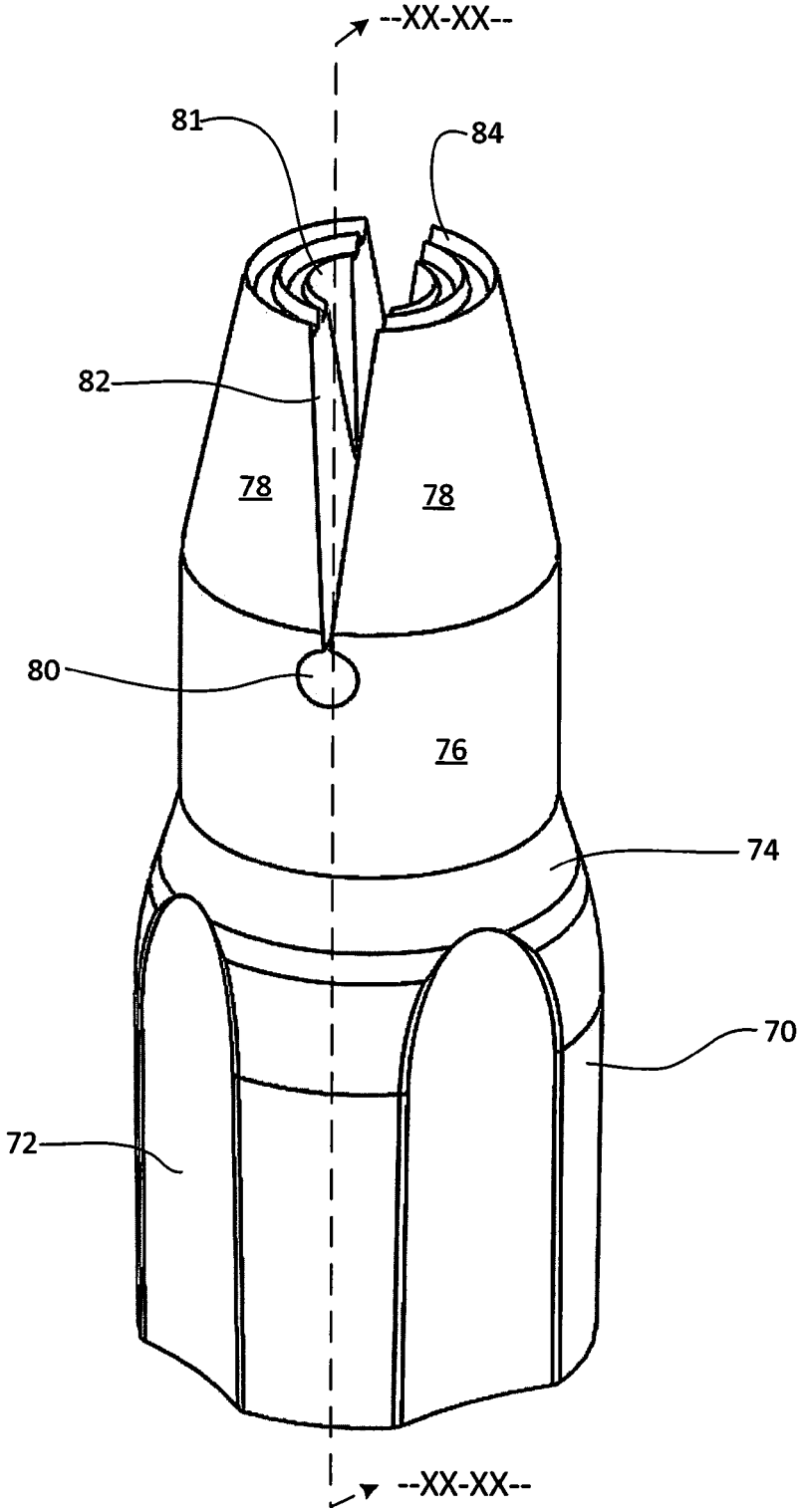
FIG. 19 is a perspective view of an extractor head according to the present invention.
Figure 20:
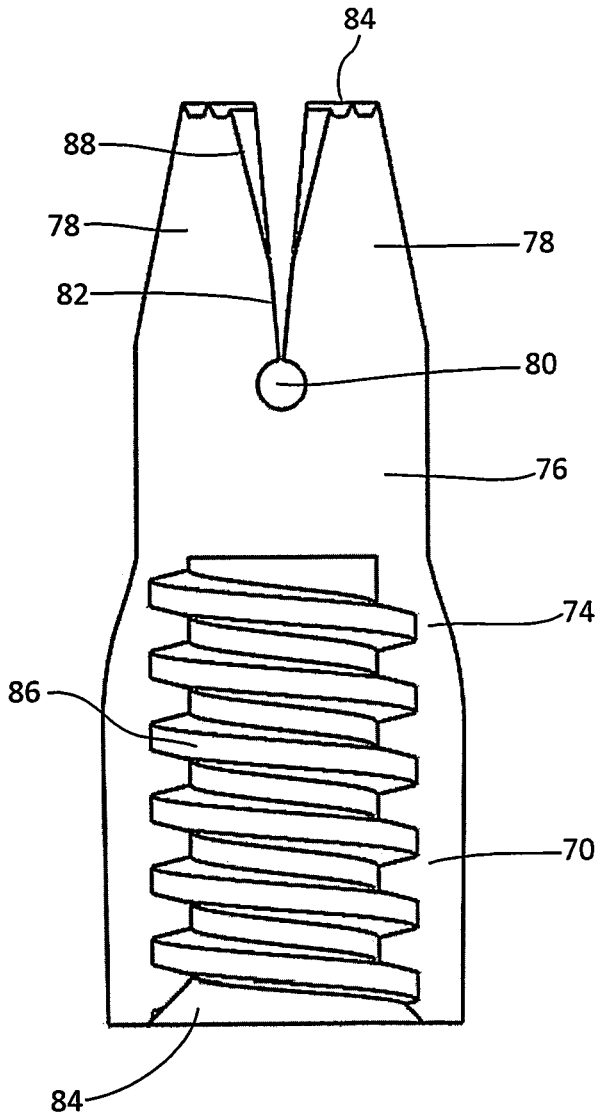
FIG. 20 is a cross-section view of the extractor attachment head shown in FIG. 19 and cut along the line XX-XX.
Figure 21:
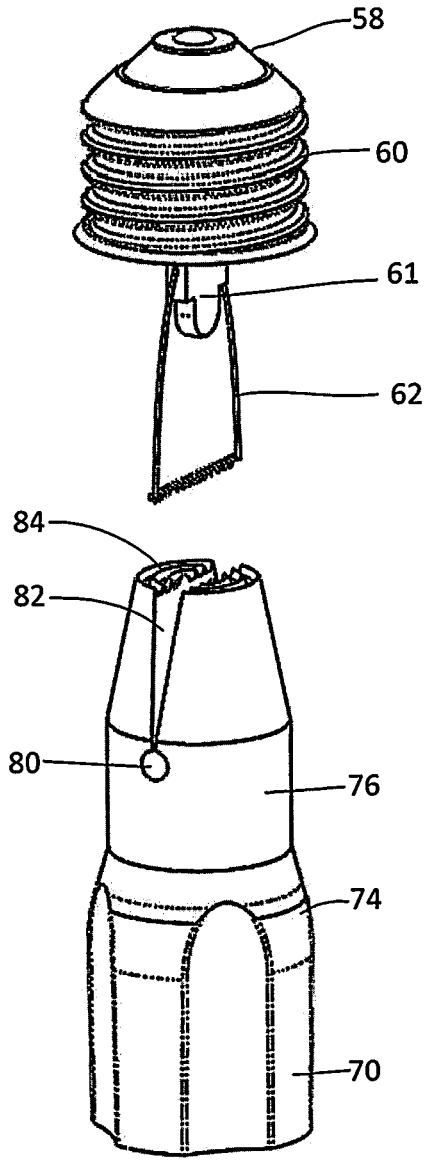
FIG. 21 is a perspective view of the extractor head of the present invention as it cooperates with a broken light bulb.

FIGS. 19-21 illustrate the extraction head 40 of the present invention. The extraction head 40 is configured to cooperate with a broken light bulb 58 and in particular with a broken incandescent light bulb base cap 60, filament glass stem 61, and filament 62 as shown in FIG. 21. The filament 62, however, is not always present with a broken light bulb. The extraction head 40 comprises a base shaft 70, a central body section 76, and a tapered flanged expansion section 78.

The proximal end of the extraction head comprises a base shaft 70, has four equidistantly spaced longitudinally elongated recessed grooves 72 on the external surface to allow for gripping the device/tool by hand and/or allowing for finger placement to rotate the device/tool for the removal and replacement of threaded light bulbs. Base shaft 70 further includes attachment components to facilitate attaching it to pole 20 or another device. Preferably, as shown in FIG. 20, the attachment components comprises a taped opening 84 that transitions to and is in fluid communication with an internal female threaded section 86 to allow for the attachment of an extended handle, various dimensioned fixed length poles, an extendable telescoping pole, or a flexible articulating knuckle. Base shaft 70 further comprises an external downward tapered ramped section 74, reducing in nominal thickness to form the elongated central main body section 76, which continues vertically, until it terminates with the uppermost tapered conical shaped flanged expansion section 78. The central main body section 76, has a horizontal through hole in it 80, to allow for the two halved conical shaped flange expansion 78 sections to expand outward when a filament glass stem is inserted into the extractor and to do so without splitting the lower central main body section 76 in half when the extractor is pushed into the glass light base cap 60. The uppermost tapered conical shaped flanged expansion section 78 is split into two sections by the vertically elongated and tapered downward slit 82, which allows for the glass filament stem to easily insert into it. The distal end of the extractor head 40 has serrated end flanges 84, as shown in FIGS. 19, 20, and 21, which is more resilient allowing for the serrated edges to bend and flex over the internal section of the light bulb base cap 60 where the two are sealed together with a smooth glassy rigid epoxy adhesive. In one embodiment the uppermost tapered conical shaped flanged expansion section 78, has an adhesive system (not shown) attached around the tapered exterior section. The uppermost tapered conical shaped flanged expansion section 78 optionally can be enhanced with a vertically tapered central hollow conical shaped core 81, to further ease and centrally position the insertion of the central glass filament stem 61.

Base shaft 70, main body section 76, and expansion section 78 can be separate components attached together with fasteners, adhesive, or other attachment components, or they can be integrally formed. Base shaft 70 can be manufactured from a polymer such as polyethylene. Elongated central main body section 76 can be manufactured from compliantly pliable soft elastomeric composition to allow for the gripping of the serrated distal end flanges against the smooth glassy rigid epoxy adhesive and to allow for the expansion of the uppermost tapered conical shaped flanged expansion section 78 to be forced outward away from the central light bulb filament glass stem 61, and against the inside of the light bulb base cap 60.

Articulating Joint

Figure 22:
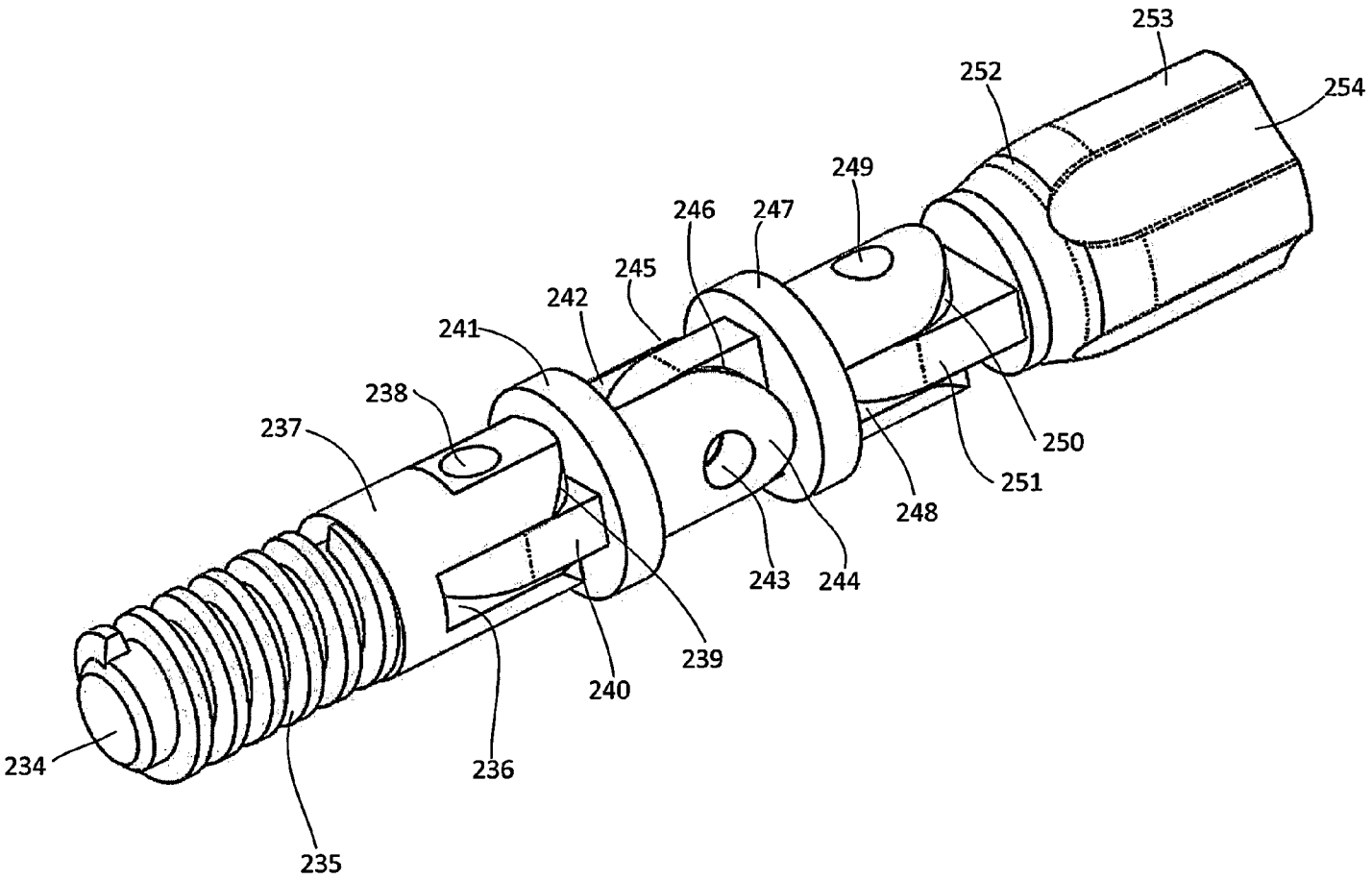
FIG. 22 is a perspective view of an articulating joint according to the present invention.

FIG. 22 illustrates the preferred articulating joint 30 of the present invention. The articulating joint is configured to cooperate with both the attachment heads 100 or extraction head 40 and the pole 20. Articulating joint 30 preferably comprises several component sections that are described below. FIG. 22 illustrates the articulating joint as having an external male threaded section 235 and an internal female threaded section 253. It should be understood by someone skilled in the art, however, that section 235 could be an internal threaded section while section 253 is an external male threaded section, that both sections 235 and 253 could be internal female threaded, or that both sections 235 and 253 could be external male threaded and still fall within the scope of the present invention.

First section 235 attaches to a central forked shaft section 237. Central forked shaft section 237 has two forks that are split with a central hollow cavity section 236 that allows for a knuckle pin end to be inserted into it. Each fork section defines a mounting pin hole 238 to allow for the insertion of either a split pin, tapered pin, sex bolt, or screw and nut fasteners to firmly attach the knuckle joints together as is known in the art. Utilizing recessed sex bolts or screw and nut fasteners provides additional capability to tighten or loosen the joint flexibility if needed. Additionally, each fork comprises tapered ends 239 to allow for the turning on the fork shaft section in its plane relative to the second knuckle joint eye shaft end 240, which is also preferably tapered. The distal male knuckle end section 237 attaches to the second knuckle joint eye shaft end 240 through the use of the above mentioned fasteners through the two fork section holes 238. The second knuckle joint has a central raised radial shoulder 241, which separates the joint eye shaft end 240 from the joint forked end 244. The joint forked end 244 has two forks each with a mounting pin hole 243 for the connecting fastener insertion. The second knuckle fork joint ends 244 utilizes the central hollow section 242 to accommodate the first knuckle joint eye shaft end 245 to complete the connection between the first and second knuckle joints. The second knuckle joint ends 244 are tapered 246 to allow for the turning within the fork shaft hollow cavity section in its plane relative to the first knuckle joint eye shaft 245, which also has a tapered eye end. The first knuckle joint has a central raised radial shoulder 247 that separates the joint eye shaft end 245 from the joint forked ends each with a mounting pin hole 249 and being tapered to allow for the turning within the fork shaft hollow cavity section 250. The first knuckle joint forked ends connect to the proximal eye end 251 though the mounting pin hole 249. The proximal eye end 251 is tapered to allow it to turn within in its plane relative to the first knuckle fork the hollow cavity 248. The proximal eye end 251 terminates though an external ramped section 252 and increases in nominal thickness to form the female threaded shaft section 253, which on the external surface has four equidistantly spaced longitudinally elongated recessed grooves 254 to allow for gripping the articulating joint 30 by hand or allowing for finger placement to rotate the articulating joint 30 during the removal and attachment to the other light bulb removal and replacement tools or components and to any additional extended handles, various dimensioned fixed length poles, or extendable telescoping poles.

Use of the System

To use the system described herein, a user first selects the attachment head 100 or extraction head 40 that best cooperates with the light bulb to be installed or removed. The user also examines the type of bulb and determines if a second adhesive system 120 and spacer 140 is needed. The user also examines the location of the light fixture where the light bulb will be removed or installed to determine if the articulating joint will be necessary such for light fixtures located on a ceiling at an angle and if some sort of pole 20 will be necessary such as for light fixtures located substantially overhead. According to the observed conditions, the user assembles the necessary components.

Once the system has been assembled with all of the necessary components and where a light bulb is to be installed, the user removes the release liner 128 from the bulb adhesive 125 and sets the release liner 128 aside for later use. Next, the user places the selected light bulb on the bulb adhesive 125 such that it adheres to the adhesive and such that it is substantially centered on the adhesive system 120 and bulb cavity 112. The user then grips the attachment head 100 by its handle 104 or alternatively the pole 20 where a pole 20 was necessary and positions the bulb so that it can be installed into the light figures. The user proceeds to install the bulb by rotating the handle 104 or pole 20 to cause the attachment head and bulb to likewise rotate. Alternatively, if the fixture accommodates pins or the like, then the user simply presses the bulb in place. After the bulb has been fully installed into the light fixture, the attachment head 100 is tilted slightly by adjusting the handle 104 or pole 20 until the user feels the light bulb make contact with the release lip 114. Then, by applying slight pressure and a turning or rotational force at the same time, the user can remove the attachment head 100 and adhesive 125. By using this method and due to the release lip 114 and air channel 116, the adhesive 125 is released without the need to pull against the full adhesion properties of the adhesive, and the removal leaves no residual adhesive material on the exterior of the light bulb. The user finishes by replacing the release liner 128 back on the bulb adhesive 125 to preserve its adhesion properties and to prevent contamination until the next time it will be used. The components can further be disassembled for storage.

Where a light bulb is to be removed from a light fixture, once the system has been assembled with all of the necessary components, the user removes the release liner 128 from the bulb adhesive 125 and sets the release liner 128 aside for later use. The user then grips the attachment head 100 by its handle 104 or alternatively the pole 20 where a pole 20 was necessary and positions the bulb so that it is adjacent the light bulb to be removed from the light fixture. Next, the user positions the attachment head 100 such that the selected light bulb adheres to the adhesive 125 and such that it is substantially centered on the adhesive system 120 and bulb cavity 112. The user proceeds to remove the bulb by rotating the handle 104 or pole 20 to cause the attachment head 100 and bulb to likewise rotate. Alternatively, where the fixture and bulb are attached with pins or the like, the user simply pulls and possibly wiggles device slightly to remove the bulb. After the bulb has been fully removed from the light fixture, the attachment head 100 is tilted slightly by adjusting the handle 104 or pole 20 or the bulb until the user feels the light bulb make contact with the release lip 114. Then, by applying slight pressure and a turning or rotational force at the same time, the user can remove the attachment head 100 and adhesive 125. By using this method and due to the release lip 114 and air channel 116, the adhesive 125 is released without the need to pull against the full adhesion properties of the adhesive, and the removal leaves no residual adhesive material on the exterior of the light bulb. The user finishes by replacing the release liner 128 back on the bulb adhesive 125 to preserve its adhesion properties and to prevent contamination until the next time it will be used. The components can further be disassembled for storage.

Where a broken bulb 58 is to be removed from a light fixture, once the system has been assembled with all of the necessary components and where one of the components is the extraction head 40 in the place of an attachment head 100, the user grips the extraction head 40 by its handle or alternatively the pole 20 where a pole 20 was necessary and positions the extraction head 40 so that the flanged expansion section 78 cooperates with the light bulb base cap 60, filament glass stem 61, and filament 62. The user proceeds to remove the broken bulb by applying a slight pressure while rotating the handle or pole 20 to cause the extraction head and broken bulb to likewise rotate. After the broken bulb 58 has been fully removed from the light fixture, broken bulb 58 is removed from the extraction head 40. A new bulb can then be installed as described above, and the components can further be disassembled for storage.

While it has been illustrated and described what is at present considered to be the preferred embodiment of the present invention, it will be understood by those skilled in the art that various changes and modifications may be made and equivalents may be substituted for elements thereof without departing from the true scope of the invention disclosed, but that the invention will include all embodiments falling within the scope of the claims.

We claim:

1. A light bulb installation and removal tool comprising:

a. a handle comprising an outer surface, a proximal end, and a distal end and defining at least one hollow bore at its distal end; and b. a gripping unit comprising:

i. a substantially circular bulb cavity fixedly attached to the handle at its distal end, wherein the bulb cavity comprises an engagement surface configured to cooperate with the distal end of a light bulb, a substantially continuous release lip surrounding the bulb cavity at its circumference and configured to cooperate with the distal end of a light bulb and to facilitate disengagement of the light bulb from the gripping unit, and a bulb cavity opening defined by the bulb cavity and in fluid communication with the hollow bore defined by the handle; and ii. an adhesive system comprising a mounting component attached to the bulb cavity engagement surface, an adhesive component comprising a pressure sensitive adhesive and removably attached to the mounting component, and a release liner removably attached to the pressure sensitive adhesive of the adhesive component, wherein:

1. the adhesive system is configured to cover only a portion of the engagement surface such that an air channel is defined around the outer edge of the adhesive system by the engagement surface, release lip, and outer edge of the adhesive system;

2. the adhesive component further defines a first opening, the mounting component further defines a second opening, and the first opening, the second opening, the bulb cavity opening, and the bore defined by the handle are all in fluid communication; and 3. the size of the first opening defined by the adhesive component is smaller than the size of the second opening defined by the mounting component.

2. The light bulb installation and removal tool of claim 1 wherein the handle further comprises threads at its proximal end configured to cooperate with threads on one or more attachable components.

3. The light bulb installation and removal tool of claim 2 wherein the handle further comprises one or more grips fixedly attached to the outer surface of the handle.

4. The light bulb installation and removal tool of claim 2 wherein the threads at the proximal end of the handle are internal female threads configured to cooperate with external male threads on one or more attachable components and wherein the bore defined by the handle extends lengthwise along a central axis of the handle from its proximal end to its distal end.

5. The light bulb installation and removal tool of claim 1 wherein the adhesive system further comprises hook and loop closures configured to attach the adhesive component to the mounting component.

6. The light bulb installation and removal tool of claim 1 wherein the bore defined by the handle and the opening defined by the bulb cavity are each substantially centered along a central axis extending lengthwise from the proximal end to the distal end of the handle and wherein the bore defined by the handle is partially tapered near the distal end of the handle.

7. The light bulb installation and removal tool of claim 1 further comprising two extensions extending from the release lip of the bulb cavity and configured to cooperate with extended fluorescent light bulbs.

8. The light bulb installation and removal tool of claim 7 wherein the extensions taper inward toward a central axis of the handle and bulb cavity.

9. A light bulb installation and removal tool comprising:

a. a handle comprising an outer surface, a proximal end, and a distal end and defining at least one hollow bore at its distal end, wherein the bore is substantially centered along a central axis of the handle and is partially tapered at the distal end of the handle; and b. a gripping unit comprising:

i. a bulb cavity fixedly attached to the handle at its distal end, wherein the bulb cavity comprises an engagement surface configured to cooperate with light bulbs, a release lip surrounding the bulb cavity, and a bulb cavity opening defined by the bulb cavity and in fluid communication with the hollow bore defined by the handle; and ii. an adhesive system comprising:

1. a first mounting component attached to the bulb cavity engagement surface comprising hook and loop closure components and defining a second opening; and
2. a first adhesive component defining a first opening and comprising a pressure sensitive adhesive and hook and loop closure components and removably attached to the first mounting component with the cooperating hook and loop closure components;
3. wherein the adhesive system is configured to cover only a portion of the engagement surface such that an air channel is defined around the outer edge of the adhesive system by the engagement surface, release lip, and outer edge of the adhesive system;
4. wherein the first opening, the second opening, the bulb cavity opening, and the bore defined by the handle are all in fluid communication; and
5. wherein the size of the first opening defined by the adhesive component is smaller than the size of the second opening defined by the mounting component.

10. The light bulb installation and removal tool of claim 9 further comprising a release liner removably attached to the pressure sensitive adhesive of the first adhesive component.

11. The light bulb installation and removal tool of claim 9 wherein the adhesive system further comprises:

a. a spacer removably attached to the pressure sensitive adhesive of the first adhesive component;

b. a second mounting component attached to the spacer comprising hook and loop closure components and defining a fourth opening;

c. a second adhesive component defining a third opening and comprising a pressure sensitive adhesive and hook and loop closure components and removably attached to the second mounting component with the cooperating hook and loop closure components; and d. a release liner removably attached to the pressure sensitive adhesive of the adhesive component;

e. wherein the first opening, the second opening, the third opening, the fourth opening, the bulb cavity opening, and the bore defined by the handle are all in fluid communication.

12. A light bulb installation and removal tool comprising:

a. one or more attachment heads wherein each attachment head comprises:

i. a handle comprising an outer surface, a proximal end comprising threads configured to cooperate with one or more attachable components, and a distal end defining at least one hollow bore substantially centered along the central axis of the handle; and ii. a gripping unit comprising:

1. a bulb cavity fixedly attached to the handle at its distal end, wherein the bulb cavity comprises an engagement surface configured to cooperate with light bulbs, a release lip surrounding the bulb cavity, and a bulb cavity opening defined by the bulb cavity and in fluid communication with the hollow bore defined by the handle; and
2. an adhesive system comprising a mounting component attached to the bulb cavity engagement surface, an adhesive component comprising a pressure sensitive adhesive and removably attached to the mounting component, and a release liner removably attached to the pressure sensitive adhesive of the adhesive component, wherein the adhesive system is configured to cover only a portion of the engagement surface such that an air channel is defined around the outer edge of the adhesive system by the engagement surface, release lip, and outer edge of the adhesive system; wherein the adhesive system further comprises hook and loop closures configured to attach the adhesive component to the mounting component; wherein the adhesive component further defines a first opening, wherein the mounting component further defines a second opening, and wherein the first opening, the second opening, the bulb cavity opening, and the bore defined by the handle are all in fluid communication; and wherein the size of the first opening defined by the adhesive component is smaller than the size of the second opening defined by the mounting component;

b. a pole comprising a threaded end and configured to cooperate with the threads on the one or more attachment heads; and c. an articulating joint comprising a first threaded end configured to cooperate with the threads on the pole and a second threaded end configured to cooperate with the threads on the one or more attachment heads.

13. The light bulb installation and removal tool of claim 12 further comprising an extraction head comprising a threaded first end configured to cooperate with the threads on the pole and a second end comprising an expansion section configured to cooperate with components of a broken light bulb.

14. The light bulb installation and removal tool of claim 12 wherein there are two or more attachment heads and wherein at least one of the attachment heads further comprises two diametrically opposed extensions extending from the release lip of the bulb cavity and configured to cooperate with extended fluorescent light bulbs.

* * * * *